United States Patent [19]

Notaras et al.

[11] 4,163,437

[45] Aug. 7, 1979

[54] TRANSISTOR IGNITION CIRCUIT

[75] Inventors: John A. Notaras; Angelo L. Notaras; James P. Williams, all of Sydney, Australia

[73] Assignee: Solo Industries Pty. Limited, New South Wales, Australia

[21] Appl. No.: 732,370

[22] Filed: Oct. 14, 1976

[30] Foreign Application Priority Data

| | | | |
|---|---|---|---|
| Oct. 23, 1975 | [AU] | Australia | PC3692 |
| Nov. 18, 1975 | [AU] | Australia | PC4013 |
| Dec. 19, 1975 | [AU] | Australia | PC4350 |
| Jan. 30, 1976 | [AU] | Australia | PC4678 |
| Mar. 19, 1976 | [AU] | Australia | PC5272 |
| Jun. 11, 1976 | [AU] | Australia | PC6234 |

[51] Int. Cl.[2] ..... F02P 1/08

[52] U.S. Cl. ..... 123/148 E; 123/148 AC; 123/149 C; 123/149 D; 315/209 T; 315/218

[58] Field of Search ..... 123/148 E, 148 D, 148 R, 123/148 AC, 149 R, 149 C, 149 D; 315/209 T, 218

[56] References Cited

U.S. PATENT DOCUMENTS

| | | | |
|---|---|---|---|
| 3,484,677 | 12/1969 | Piteo | 123/148 E |
| 3,548,800 | 12/1970 | Lombardini | 123/148 E |
| 3,559,134 | 1/1971 | Daley | 336/205 |
| 3,822,686 | 7/1974 | Gallo | 123/148 E |
| 3,831,570 | 8/1974 | Compton et al. | 123/148 E |
| 3,861,372 | 1/1975 | Shibukawa et al. | 123/148 R |
| 3,864,621 | 2/1975 | Haubner et al. | 315/209 T |
| 3,864,622 | 2/1975 | Haubner et al. | 133/148 E |
| 3,878,452 | 4/1975 | Haubner et al. | 123/148 E |
| 3,878,824 | 4/1975 | Haubner et al. | 123/148 E |
| 3,881,458 | 5/1975 | Roozenbeek et al. | 123/148 E |
| 3,938,491 | 2/1976 | Mazza | 123/148 E |
| 3,963,015 | 6/1976 | Haubner et al. | 123/148 E |

FOREIGN PATENT DOCUMENTS

| | | | |
|---|---|---|---|
| 45-4924 | 2/1970 | Japan | 123/148 E |

*Primary Examiner*—Charles J. Myhre
*Assistant Examiner*—Andrew M. Dolinar
*Attorney, Agent, or Firm*—Henry M. Bissell

[57] ABSTRACT

The present invention discloses an ignition system for internal combustion engines. The ignition system is particularly applicable to such engines including a magneto.

The ignition system includes a semi-conductor ignition circuit in which a first transistor has its collector-emitter conduction path connected in series with the primary winding of an ignition coil assembly. A resistor is connected between base and collector of the first transistor to permit it to conduct. A control circuit connected between the base of the first transistor and the primary winding, turns the first trnasistor off when it is desired to interrupt the primary winding current.

The ignition system also includes a magneto ignition coil assembly which has a low inductance primary winding having a relatively low number of turns. The coil assemblies of the present invention are generally unsuitable for use with conventional mechanical breaker points.

22 Claims, 44 Drawing Figures

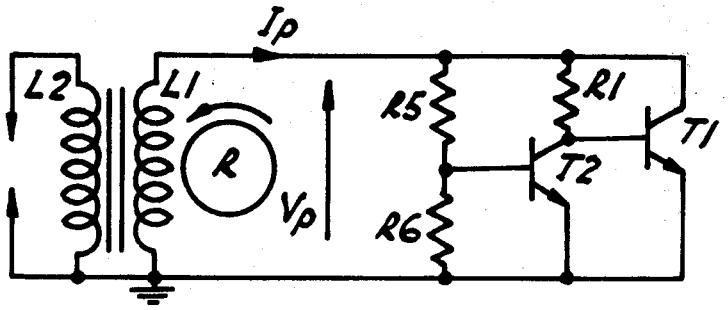

TRANSISTOR IGNITION CIRCUIT

The present invention relates to internal combustion engines and provides a complete ignition system for such engines. The ignition system includes both transistor ignition circuits and coil assemblies. The invention is particularly suitable for use with internal combustion engines having a magneto but is not limited thereto.

Hitherto conventional magneto ignition system have comprised a coil and a set of contact points. The coil is typically wound on the centre leg of a 3-legged, E-shaped core of one leg of a 2-legged U-shaped core formed from a plurality of laminations. Alternatively the single leg of an I-shaped core may be used. The coil itself normally comprises a primary winding would close to the centre leg of the core and a secondary winding which is coaxial with and exterior of the primary winding.

A magnetic source, which typically comprises a magnet or magnets, is rotatable past the coil and core in synchronism with the crankshaft of the internal combustion engine. The contact points are connected across the primary winding of the coil and are operable by means of a cam which moves in synchronism with the magnet carrying magneto rotor. One side of the contact points is generally earthed and one side of the secondary winding is generally also earthed by means of the frame and cylinder block of the internal combustion engine. The unearthed end of the secondary winding of the coil is directly connected to the spark plug(s) of the engine.

The movement of the magnets in the magneto rotor past the core induces a voltage pulse in the primary winding of the coil. The magnitude of the open-circuit primary winding voltage pulse is substantially proportional to the surface speed of the magnets in the magneto rotor. The magnitude of the open-circuit primary voltage pulse is also dependent upon fixed quantities such as the shape and quality of the laminations and the size and strength of the magnets.

The closure of the points is timed to substantially coincide with, or precede, the generation of the voltage pulse within the primary winding of the coil. When the contact points close, the primary winding of the coil is substantially short-circuited and therefore a current flows in the primary winding. This flow of current created in the primary winding is interrupted when the points open, thereby inducing a change in the magnetic flux linking both the primary and secondary winding of the coil. In consequence a voltage is generated in the secondary winding of the coil which, because of the large number of turns on the secondary winding, is of sufficient magnitude to cause a spark within the cylinder of the internal combustion engine.

The major limiting factor in such conventional magneto ignition systems has hitherto been the condition of the points. It has been found in practice that if a large current flows through the points, the points rapidly become pitted and burnt. This result is caused by arcing across the points produced by the back emf of the primary winding and reflected secondary winding inductance and by the sudden interruption to the flow of current in the primary winding.

Furthermore internal combustion engines are often required to operate in dirty and dusty conditions and therefore it is desirable that the contact points of the system be self-cleaning. For this to occur a sufficient current must flow through the points in order to overcome and burn away any oil, dust, dirt and/or fungal growth on the points. This ensures good conduction for the flow of primary winding current whilst the contact points are closed. In order to meet these requirements coils for magneto ignition systems produce a short-circuit primary winding current in the vicinity of 2 to 3 Amps when the points of the system are closed. Such a current is considered to be the optimum required for self-cleaning and yet even so the cleaning, replacement, and retiming of the contact points of conventional magneto ignition systems constitutes the major source of maintenance that these systems require.

In order to overcome the abovementioned problems with contact points, in recent years there have been several attempts to provide solid state electronic circuits which function to replace the conventional breaker points system. Such an electronic system is that described in U.S. Pat. No. 3,878,452 (corresponding to Australian Patent Application No. 59,669/73) in the name of Robert Bosch G.m.b.H and commercially available as a Bosch electronic ignition type 525 1/217/280/032. The abovementioned commercially available Bosch electronic ignition is fitted to a Husqvarna brand chain saw, for example.

Whilst electronic ignition systems such as the above-described Bosch system overcome the abovementioned disadvantages of contact points, they are expensive because the circuitry they employ requires the use of expensive high voltage breakdown electronic devices. In addition, and more importantly, such electronic ignition systems have not been able to provide starting at low engine revolutions and the abovementioned Bosch electronic ignition type, when fitted to a Husqvarna chain saw, results in starting only at 1,100 R.P.M. which corresponds to a rotor speed of 955 surface feet per minute.

Whilst the starting speed in the vicinity of 1,000 R.P.M. is adequate for small chain saws, such a high starting speed is not adequate for most two and four stroke engines, especially those having heavy, high inertia parts such as heavy flywheels, heavy lawn mover blades and discs, and other such heavy inertial loads connected to the engine crankshaft.

Such engines require starting speeds in the vicinity of 400 to 600 R.P.M. and, to date, such low starting speeds have been unobtainable by the abovementioned known electronic ignition systems. Therefore such electronic ignition systems have not found favour and the conventional ignition systems including breaker points have continued to be used.

The number of two and four stroke engine made worldwide which are fitted with magneto ignition systems including breaker points is in excess of twenty million engines per year. The number of small four stroke engines made in the U.S.A. alone exceeds fifteen million per annum and the overwhelming majority of these engines are fitted with magneto ignition systems having breaker points. Therefore the economic consequences in any alteration in ignition systems used by such manufacturers are very significant.

In addition, not only are known electronic ignition systems (excluding capacitor discharge systems) and the magnetos for such systems unsuitable for the bulk of such engines because they are incapable of producing starting at speeds between 400 and 600 R.P.M., but in particular such known electronic systems are incapable of use where very low speed starting is required.

Very low speed starting is required in some applications such as engines fitted with a decompression valve which reduces the compression resistance experienced by the crankshaft during manual cranking of the engine. Also very low speed starting is required in those engines which are designed to be manually cranked by women and members of both sexes which are aged or infirm and therefore do hot have sufficient physical strength to create a high cranking speed. Such applications in which low starting speeds are especially advantageous are lawn mowers and motor cycles which are intended for use by members of all sexes and all ages.

It is the object of the present invention to provide an ignition system which does not require points and which enables reductions in engine starting speeds to be achieved.

The present invention encompasses both ignition circuits and coil assemblies. The ignition circuits of the present invention may be used with conventional coil assemblies and improved results are obtained. In addition the coil assemblies of the present invention may be used with conventional electronic ignition circuits and improved results are also obtained.

However, when both the ignition circuits and coil assemblies of the ignition system of the present invention are used together, not only are further improvements in results obtained, but advantages are achieved which enable the total cost of the ignition system as a whole to be significantly reduced.

Some embodiments of the present invention will now be described with reference to the drawings in which:

FIG. 1 is a composite circuit diagram taken from the abovementioned U.S. Pat. No. 3,878,452 which is known prior art;

Figure 1:
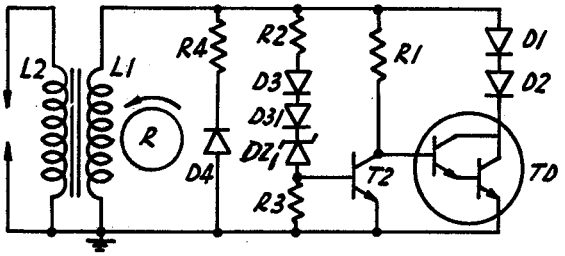

Referring now to FIG. 1, there is illustrated a circuit diagram which is a composite figure taken from U.S. Pat. No. 3,878,452 assigned to Robert Bosch G.m.b.H which represents an ignition system which is typical of those used hitherto in two respects. These are that a conventional ignition coil designed for operation of contact points is used, and secondly the semi-conductor device, which is used to substitute for the previously used mechanical breaker points, is switched between non-conduction and saturation.

The ignition system itself comprises an ignition coil having a primary winding L1 and a secondary winding L2 which are magnetically coupled. A rotor R which carries one or more magnets is rotatable past the primary winding L1 so as to induce an approximately sinusoidal voltage waveform therein for each revolution of the rotor R.

As explained in more detail in the abovementioned U.S. Patent, induced voltages of negative polarity cause a current to flow through the diode D4 and resistor R4 which returns to the primary winding L1. However, positive polarity voltages induced in the primary winding L1 cause sufficient current to flow through the resistor R1 and into the base of the Darlington transistor TD, to allow the Darlington transistor TD to conduct the primary winding current between its collector an emitter via the diode D1 and D2. The voltage drop produced across the diodes D1 and D2 when added to the collector saturation voltage of the Darlington transistor TD, ensure that there is sufficient voltage across resistor R1 and the effective base-emitter junction of the Darlington transistor TD to cause sufficient base current to flow through resistor R1 and into the base of the Darlington transistor TD. Accordingly transistor TD is maintained in the saturated condition.

Resistors R2 and R3 together with diodes D3, D31 and DZ1 constitute a potential divider. The base of transistor T2 is connected to a point of intermediate potential on the abovementioned potential divider and the collector-emitter conduction path of transistor T2 is connected in parallel with the effective base-emitter conduction path of the Darlington transistor TD.

As the positive voltage induced in the primary winding L1 increases towards a predetermined voltage, the voltage appearing across resistor R3 increases sufficiently to allow the transistor T2 to be turned on. When this happens the base of the Darlington transistor TD is effectively connected to the emitter of the Darlington transistor TD. Therefore the Darlington transistor TD is switched off and the current flowing in the primary winding L1 is abruptly interrupted. This abrupt interruption of the primary winding current induces a high voltage in the secondary winding L2 in conventional fashion.

The circuit of FIG. 1 suffers from several disadvantages the first of which is that a conventional mechanical breaker point type ignition coil assembly is used. As explained previously such conventional ignition coil assemblies produce relatively high voltages and sufficient current so as to enable the breaker points, for which they were designed, to carry sufficient current to be self cleaning. The maximum current produced by such coil assemblies has always been below 3 or 4 Amps to prevent excessive wear and burning of the breaker points. However, the use of such a conventional coil assembly means that the semi-conductor components of the ignition circuit must be able to withstand the high voltages and powers produced by the ignition coil. In consequence expensive semi-conductors having relatively high power and voltage ratings are required. Such semi-conductors significantly increase the cost of electronic ignition circuits known hitherto.

In addition, in the design of electronic circuits to replace conventional breaker points, the semi-conductor devices used have been considered as functional equivalents of the mechanical breaker points. This is quite understandable since the production of a high voltage in the secondary winding L2 is to be brought about by the abrupt interruption to the current flowing in the primary winding L1, and this abrupt interruption is normally achieved by means of a switch. However, the circuit design consequences of this have been that the semi-conductor devices are switched from non-conducting to saturated conditions Accordingly the biassing circuits for the semi-conductor devices have been designed with a view to driving the semi-conductor switches into saturation. In consequence the diodes D1 and D2 are provided connected in series with the Darlington transistor TD of FIG. 1 to ensure that the Darlington transistor TD becomes and remains saturated. Whilst this circuit arrangement operates as intended by its designers, the cost of providing the additional two diodes further increases the cost of the total circuit in addition to that described above in relation to the power, and voltage ratings of the semi-conductor devices.

In addition the gain of semi-conductor devices having high voltage ratings is generally low and this results in such devices being unable to produce low speed starting.

Figure 2:
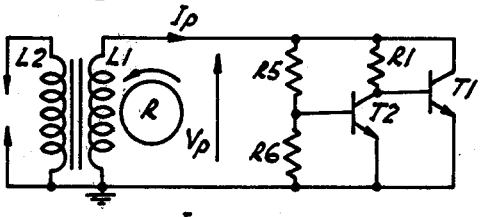
FIG. 2 is a circuit diagram of a first embodiment of the ignition circuit of the present invention.

FIG. 2 illustrates the circuit diagram of the first embodiment of the ignition circuit of the present invention. The rotor R is as before and the magneto, or ignition coil assembly, formed from primary winding L1 and secondary winding L2 may be as before but is preferably as will be described hereinafter. The remainder of the circuit comprises a first transistor T1 having its collector-emitter conduction path connected in series with the primary winding L1. A resistor R1 is connected between collector and base of the transistor T1 and a transistor T2 has its collector-emitter conduction path connected across the base-emitter junction of the transistor T1. The base of the transistor T2 is connected to a point of intermediate potential on a resistive potential divider formed by resistors R5 and R6 which are connected in series across the primary winding L1.

As the rotor R rotates a quasi-sinusoidal voltage is induced in the primary winding L1. In the circuit of FIG. 2, during the time when the induced voltage in the primary winding L1 is negative a relatively small current flows through resistors R5 and R6 and no current flows through transistor T1. However, when the induced primary winding voltage is positive a small current flows through resistor R1 and into the base of transistor T1. This base current allows the transistor T1 to conduct current induced in the primary winding L1 but is not of a sufficient magnitude to permit the transistor T1 to become saturated. Accordingly transistor T1 conducts in its active region normally used when transistors are required to function as amplifiers rather than switches. The voltage appearing at the collector of transistor T1 is always greater than that required at the base of the transistor T1 to bias the transistor in the normal active region. The difference in voltage between the base and collector of transistor T1 corresponds to the voltage drop produced in the resistor R1 by the base current flowing through resistor R1.

As the voltage induced in the primary winding L1, indicated as Vp in FIG. 2, increases the voltage appearing at the base of transistor T2 increases proportionately. Accordingly, after a predetermined period, the voltage at the base of T2 will have increased sufficiently to not only permit transistor T2 to conduct between collector and emitter but also to drive transistor T2 into saturation. As a result the voltage appearing at the base of transistor T1 is only the collector-emitter saturation voltage of the transistor T2 and this voltage is insufficient to enable the transistor T1 to conduct. Therefore transistor T1 turns off and abruptly interrupts the current flowing in the primary winding L1. The abrupt interruption of the current flowing in the primary winding L1 induces a high voltage in the secondary winding L2 in known fashion to create the desired spark.

It will be seen that the circuit of FIG. 2 is able to operate with very many fewer components than that of the prior art circuit of FIG. 1. In addition, when the magneto or ignition coil pair of the present invention is used in connection with the circuit of FIG. 2, the voltage, current and power ratings of the transistors T1 and T2 are relatively light and therefore low cost transistors may be used. This use of low cost semi-conductors together with the reduced number of components in a circuit substantially reduces the cost of the overall ignition circuit.

Figure 3:
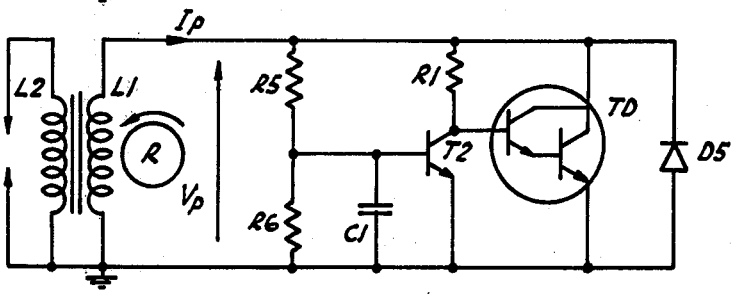
FIG. 3 is a circuit diagram of the preferred second embodiment of the ignition circuit of the present invention.

FIG. 3 illustrates the circuit diagram of the preferred embodiment of the ignition circuit of the present invention. The circuit illustrated in FIG. 3 is similar to that illustrated in FIG. 2 save that a Darlington transistor TD is used in place of the above-described first transistor T1, a diode D5 is connected in parallel with the collector-emitter conduction path of the Darlington transistor TD, but with reverse polarity, and a small capacitor C1 is preferably connected between base and emitter of the transistor T2 to assist in turning that transistor on at the time of ignition. The need for capacitor C1 to become charged before T2 turns on prevents spurious firing of the ignition circuit.

Figure 4:
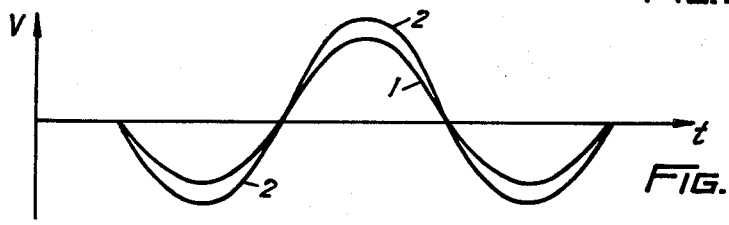
FIG. 4 is a graph of the open circuit voltage of the primary winding L1 of the ignition coil as a function of time for two individual revolutions of the rotor R.

The operation of the circuit of FIG. 3 will now be described in more detail with reference to FIGS. 4 to 7. In FIG. 4 a graph of the open circuit voltage induced in the primary winding L1 as a function of time for a single revolution of the rotor R is illustrated. Two curves (1) and (2) are illustrated, the former being the voltage induced when the rotor R is travelling at a lower speed, and the latter when the rotor R is travelling at a higher speed. The open circuit voltage induced in the primary winding L1 is substantially proportional to rotor speed and therefore the amplitude of the induced voltage increases with increasing rotor speed.

Figure 5:
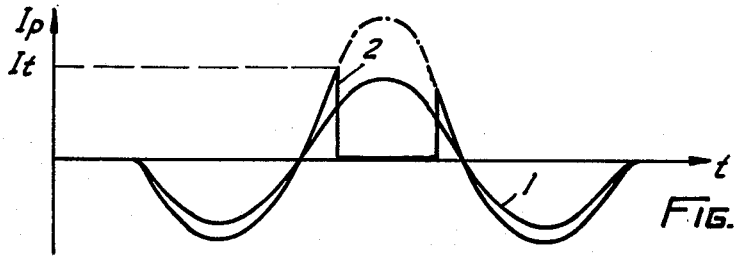
FIG. 5 is a graph of the current Ip flowing in the primary winding L1 as a function of time during two individual revolutions of the rotor R for the circuit of FIG. 3.

FIG. 5 shows a graph of the current Ip flowing in the primary winding L1. During the time when the voltage Vp induced in the primary winding is negative, a negative current flows through diode D5. When the induced voltage Vp is positive, a positive current flows through Darlington transistor TD. The curve (1) illustrates the current flowing through the Darlington transistor TD when the rotor revolutions are insufficient to cause ignition. Under these circumstances the maximum positive amplitude of the current Ip does not exceed a predetermined trigger current It.

The curve (2) of FIG. 5 illustrates the primary current Ip when rotor revolutions are sufficient to cause the transistor T2 to be switched on. It will be seen that when the primary current Ip exceeds the trigger magnitude It, the transistor T2 is switched on thereby switching off the Darlington transistor TD and abruptly interrupting the flow of primary current Ip. This interruption causes an induced voltage in the secondary winding L2 in known fashion. Whilst the transistor T2 remains on no current flows through the Darlington transistor TD.

However, the transistor T2 normally ceases to conduct during the same positive cycle of induced primary winding voltage, and at this time the voltage appearing at the base of the Darlington transistor TD is able to rise sufficiently to cause the Darlington transistor TD to conduct thereby allowing the primary winding current Ip to flow once again as illustrated in FIG. 5. The magnitude that the primary winding current Ip would have attained at the particular rotor speed concerned is indicated by the dash and dot line in FIG. 5.

Figure 6:
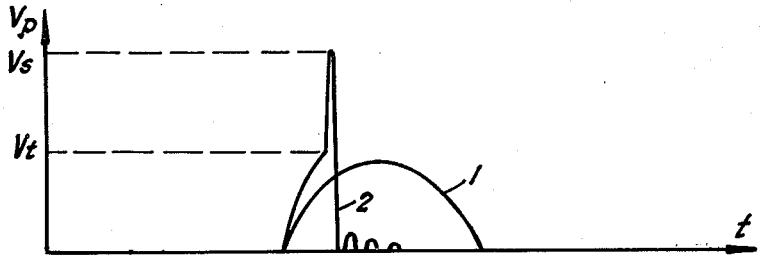
FIG. 6 is a graph of the primary winding voltage Vp as a function of time under the conditions mentioned above in connection with FIG. 5.

FIG. 6 is a graph of the voltage Vp appearing across the primary winding L1 for each of the single rotor revolutions described above in connection with FIG. 5. It will be seen that when a negative primary winding current Ip is flowing the diode D5 effectively clips the voltage Vp. The voltage curve (1) illustrates the voltage Vp when the rotor speed is insufficient to cause triggering of the ignition circuit. However, the voltage curve (2) illustrates the position at higher rotor speeds and the increased magnitude of the voltage Vp increases sinusoidally until a critical voltage Vt is reached at which triggering of the ignition circuit takes place.

Then as explained above the primary current Ip is interrupted abruptly by the Darlington transistor TD and this interruption of current induces a back e.m.f. voltage spike across the primary winding L1. This voltage spike has a magnitude Vs which is referred to as the switched voltage. A series of oscillations having only positive pulses are normally produced during the time immediately after the interruption of the primary current and then the negative cycle of clipped voltage is resumed.

Figure 7:
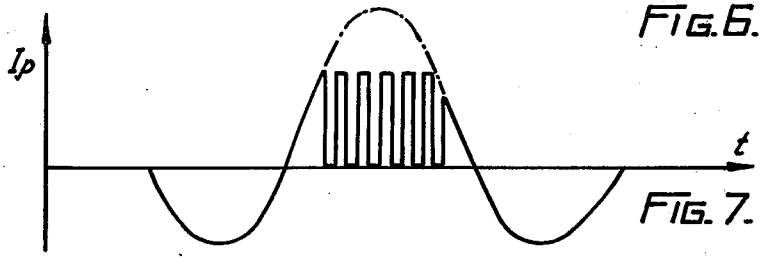
FIG. 7 is another graph of the primary winding current Ip under the conditions specified above in FIG. 5 in the situation where multiple ignition takes place in a short period of time.

FIG. 7 illustrates the primary current Ip waveform which is produced when a plurality of triggerings of the ignition circuit take place within a single cycle. Under these circumstances the transistor T2 is initially turned on to initially interrupt the primary current Ip and then quickly turns off again. Accordingly the primary current Ip commences to flow once again but has a magnitude in excess of the triggering current It. Therefore the transistor T2 turns on once more to interrupt the primary winding current Ip. This process is repeated until finally when the primary current Ip re-commences once again, its magnitude is then below the triggering current magnitude It.

Figure 8:
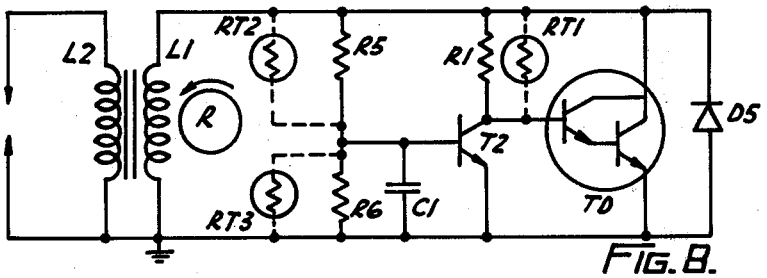
FIG. 8 is a circuit diagram showing the circuit of FIG. 3 with temperature compensation.

FIG. 8 illustrates a circuit diagram of an embodiment similar to that illustrated in FIG. 3 save that up to three thermistors, RT1, RT2 and RT3, may be provided in the circuit to provide temperature compensation in order that the operating characteristics of the circuit remain substantially the same with changes in the operating temperature of the circuit. Such changes in the operating temperature may be brought about owing to changes in ambient temperature, for example because the internal combustion engine is used in either a hot or a cold climate, or through changes in the temperature of the circuit brought about because of its proximity to a warm internal combustion engine, or even self-heating caused by flow of electrical current. Generally only one of the thermistors is required.

Any one or any combination of the three thermistors may be used, however, thermistors RT1 and RT3 are negative temperature coefficient thermistors whilst thermistor RT2 is a positive temperature coefficient thermistor. The thermistors themselves may be constructed from one or more thermistors or a thermistor and a separate conventional resistor so as to control the resistance characteristic of the effective thermistor as desired. For example, a series resistor may be connected with the thermistor RT3 and this gives slight advancement of the time of ignition with increasing operating temperature of the circuit. The thermistors are indicated as being connected in the circuit by means of dashed lines to indicate that they may be used as alternatives if desired.

Figure 9:
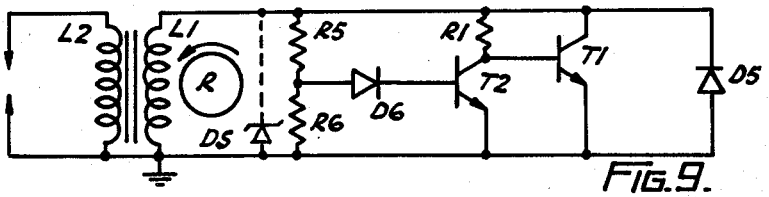
FIG. 9 is a circuit diagram of a further embodiment of the ignition circuit of the present invention.

Referring now to FIG. 9, an embodiment of the ignition circuit of the present invention is illustrated therein which is similar to FIG. 2 save that a diode D5 has been added which functions as the diode D5 in FIG. 3, and a further diode D6 has been interposed between the resistive potential divider formed by resistors R5 and R6 and the base of transistor T2. The function of diode D6 is to alter the time at which the transistor T2 is turned on for given values of resistors R5 and R6 since the potential divider must supply a sufficient voltage to forward bias the diode D6 before base current is supplied to the transistor T2.

A voltage suppressor DS such as a Zener diode, surge suppressing selenium rectifier, or the like, may be connected across the primary winding L1 as shown in FIG. 9. The voltage suppressor DS is illustrated in dashed lines to indicate that it is not essential for the operation of the circuit.

The effect of voltage suppressor DS is to prevent the magnitude of the positive voltage pulses induced in the primary winding L1 exceeding a predetermined limit. This applies whether the induced voltage pulse is caused by movement of the rotor R or by the back emf produced when the primary winding current is interrupted by transistor T1.

Since the peak positive voltage applied between collector and emitter of transistor T1 is reduced by voltage suppressor DS, the voltage rating of transistor T1 (or Darlington transistor TD) may be reduced.

Transistors of relatively low voltage rating generally have relatively high current gains. Therefore if voltage suppressor DS and a high gain transistor T1 are used, the transistor T1 will be turned off by transistor T2 as a result of a smaller positive voltage pulse induced in the primary winding L1 than previously. As a direct consequence lower speed starting can be achieved since the magnitude of the induced primary winding voltage pulse decreases with decreasing rotor speed. In addition to the reduction in starting speed, the transistors having relatively low voltage ratings also have a lower cost.

Figure 10:
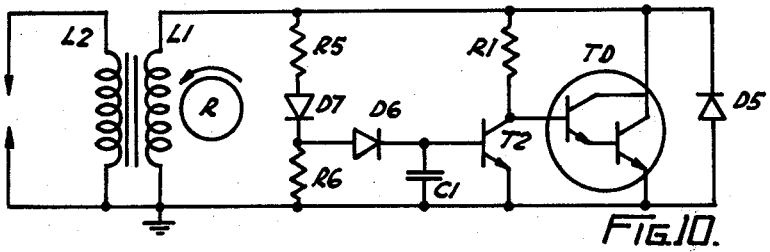
FIG. 10 is a circuit diagram similar to that of FIG. 9 illustrating still another embodiment of the ignition circuit of the present invention.

FIG. 10 illustrates a circuit similar to that of FIG. 9 save that a Darlington transistor TD is used in place of transistor T1 and a further diode D7 is provided in the potential divider. Again the diode D7 delays the time of ignition for given values of resistors R5 and R6 since the diode D7 must also be forward biassed before base current can be supplied to the transistor T2. In addition the capacitor C1 is provided to assist in turning on the transistor T2 as in FIG. 3. It is to be understood that further series connected diodes may be provided in addition to diode D7 to further delay the time of ignition and that Zener diodes may also be provided in this position of the potential divider.

Figure 11:
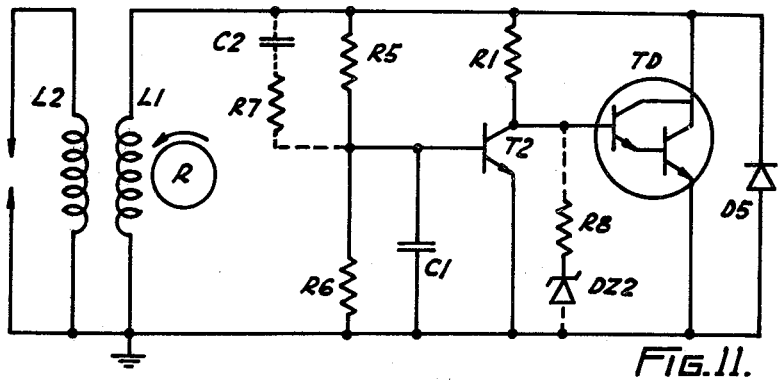
FIG. 11 is a circuit diagram of an embodiment of the present invention incorporating automatic spark advance.

FIG. 11 illustrates a further embodiment of the ignition circuit in which either a series connected capacitor C2 and resistor R7 are connected in parallel with the resistor R5 of the circuit of FIG. 3, or a series connected resistor R8 and Zener diode DZ2 are connected between base and emitter of the Darlington transistor TD. These circuit additions are indicated by dashed lines to indicate that they are alternative connections.

The function of resistor R7 and capacitor C2 is to allow the voltage appearing at the base of transistor T2 to rise more quickly during the positive cycle of the voltage Vp appearing across the primary coil L1. Accordingly the transistor T2 turns on more quickly during the operating cycle of the internal combustion engine and this effectively advances the time of ignition by 1 or 2 mechanical degrees of the rotor rotation.

The resistor R8 and Zener diode DZ2 draw current via resistor R1. Therefore less current is available via resistor R1 to provide the base current for Darlington transistor TD. As a result the Darlington transistor TD does not conduct until later than normal during the positive voltage pulse.

Because the conduction of Darlington transistor TD is delayed more current is available at the beginning of the positive pulse to begin charging capacitor C1. Thus when the Darlington transistor TD is conducting only a short time is required before capacitor C1 has become charged to the point where transistor T2 turns on. Thus the time of ignition is advanced.

Figure 12:
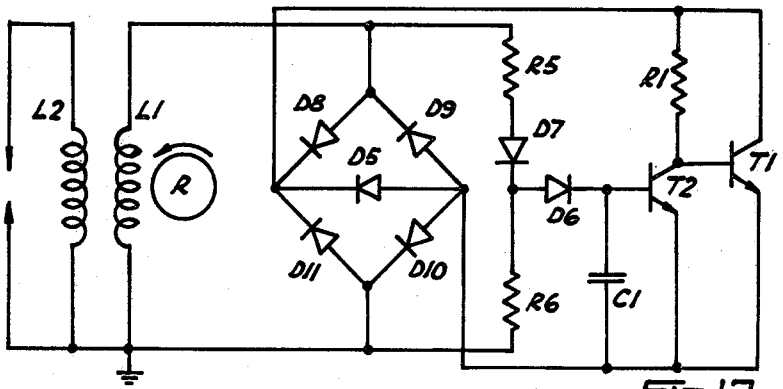
FIG. 12 is a circuit diagram of a still further embodiment of the present invention incorporating a diode bridge.

FIG. 12 illustrates a circuit of a further embodiment of the ignition circuit of the present invention in which a diode bridge formed from diodes D8 to D11 rectifies the quasi-sinusoidal voltage and current waveforms induced in the primary winding L1 and applies them to a first transistor T1. The first transistor T1 has a resistor R1 connected between its base and collector and a second transistor T2 having its collector-emitter conduction path connected in parallel with the base-emitter conduction path of transistor T1. A capacitor C1 is connected between base and emitter of transistor T2 as before. Therefore a series of positive pulses are applied to the transistor T1 at a rate 2 or 3 times that previously applied.

The unrectified pulses produced by the primary coil L1 are applied directly to a potential divider comprising resistors R5 and R6 and diode D7. The base of transistor T2 is connected to a point of intermediate potential on the potential divider via a diode D6. A diode D5 is connected in the diode bridge so as to be in parallel with the collector-emitter conduction path of the first transistor T1 as before and protects the transistor T1 from any excessive negative voltages.

The presence of diode D7 in the potential divider means that only the positive pulses result in current flow through resistors R5 and R6. Thus the base of transistor T2 only receives a voltage sufficient to cause base current to flow into the transistor T2 during the positive pulses produced by primary winding L1. In this regard the circuit of FIG. 12 operates in a manner similar to those circuits described above, however, during the negative pulses produced by the primary winding L1, although there is a positive pulse applied to the transistor T1 which conducts the negative pulses of primary winding current, this current is not interrupted during the negative pulses, since transistor T2 is not turned on. Therefore the current flowing in the primary winding L1 is interrupted at the same rate with the circuit of FIG. 12 as it is in the circuits of the previously described Figures, thereby achieving correct timing.

The diodes D6 and D7 of FIG. 12 are preferments and may be removed if desired. The action of the potential divider formed by resistors R5 and R6 is then as described above in FIGS. 2 and 3.

Figure 13:
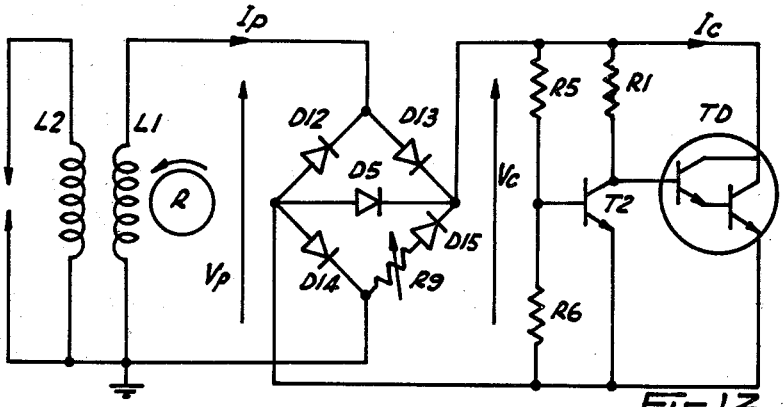
FIG. 13 is a circuit diagram of a further embodiment of the ignition circuit of the present invention incorporating automatic spark advance.

The circuit shown in FIG. 13 enables the time of ignition to be advanced once engine revolutions have reached a predetermined magnitude. The circuit comprises resistors R1, R5 and R6 and transistor T2 and Darlington transistor TD as before which are connected to the magneto comprising coils L1 and L2 via a diode bridge formed from diodes D12 to D15. Diode D5 is connected as before and one of diodes D12 or D15 preferably has a variable resistor R9 connected in series therewith.

Figure 14:
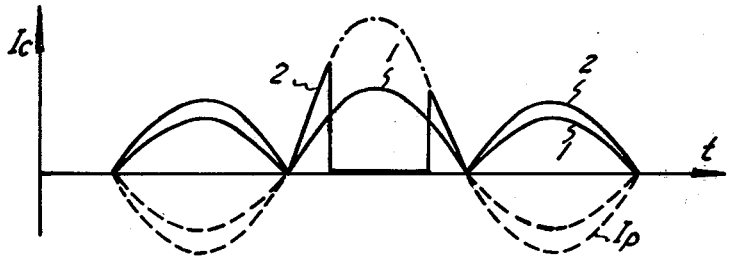
FIG. 14 is a graph of collector current Ic against time for the circuit of FIG. 13 at relatively low rotor speeds.

The operation of the circuit of FIG. 13 may best be understood with reference to FIGS. 14 to 17 which show the voltage and current curves for the circuit of FIG. 13 at three different speeds. FIG. 14 shows the collector current Ic of the Darlington transistor TD at two speeds, the first curve (1) representing a rotor speed which is too low to produce ignition and the second curve (2) representing the current produced when the rotor speed is sufficient to cause ignition. In both cases the negative current pulses of the primary winding current Ip are indicated by dashed lines and have been rectified to form the collector current Ic. The presence of resistor R9 acts to reduce the magnitude of these rectified negative pulses as will be explained hereinafter.

The positive pulse of the current Ip is transmitted through the diode bridge and in the case of curve (2) has a magnitude sufficient to trigger the transistor T2 and thereby cause the Darlington transistor TD to cease conduction.

Figure 15:
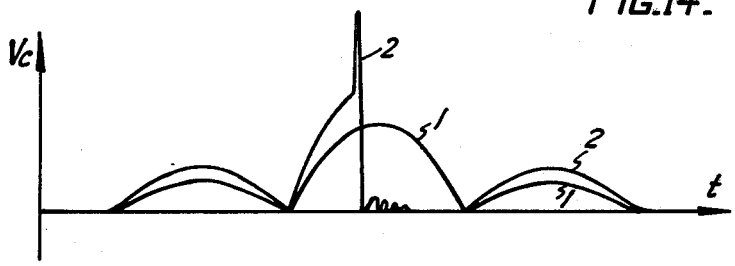
FIG. 15 is a graph of collector voltage Vc against time for the circuit of FIG. 13 at relatively low rotor speeds.

FIG. 15 shows the similar situation for the collector voltage Vc which appears between emitter and collector of the Darlington transistor TD. Again the negative voltage pulses of the primary winding voltage Vp have been rectified and as illustrated in curve (2) the speed of the rotor is sufficient to cause ignition.

Figure 16:
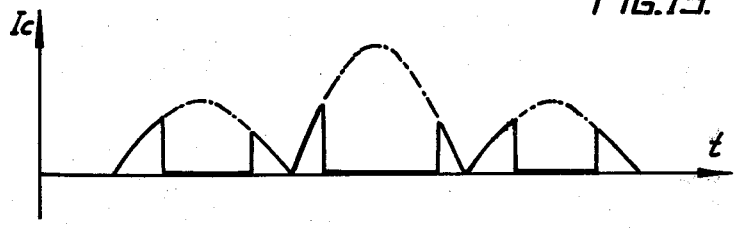
FIG. 16 is a graph of collector current Ic against time for the circuit of FIG. 13 at a relatively high rotor speed.
Figure 17:
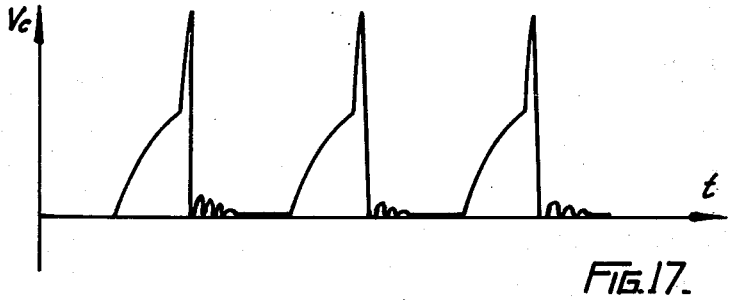
FIG. 17 is a graph of collector voltage Vc against time for the circuit of FIG. 13 at a relatively high rotor speed.

The position when the rotor revolutions have increased sufficiently to cause advancement of the spark is illustrated in FIGS. 16 and 17. FIG. 16 illustrates the current waveform for the collector current Ic, the first rectified pulse of which will have attained a magnitude sufficient to cause triggering of the transistor T2. Accordingly the Darlington transistor TD first interrupts the primary current Ip at a time during the first negative pulse of primary winding current. Therefore the time of ignition has been advanced. The rotor revolution rate at which the advancement of the time of ignition first occurs may be adjusted by altering the magnitude of the resistor R9. The greater the value of this resistance the more the attenuation of the rectified negative current pulses and the greater the speed required for the automatic spark advance to first come into action. Once this minimum speed has been attained there will be an advancement of ignition time with increasing speed. Advancements of the order of 10 to 35 mechanical rotor degrees may be achieved. The collector voltage Vc waveform during automatic spark advance is illustrated in FIG. 17.

In the event that the magnitude of the negative pulse(s) produced by the rotor is lower than the magnitude of the positive pulse, then it is possible to remove the resistor R9 from the circuit of FIG. 13 since the attenuation function that resistor R9 provides is automatically provided by the magneto construction. However, if the variable resistor R9 is removed it is then not possible to adjust the engine revolutions at which the automatic advance first occurs.

Figure 18:
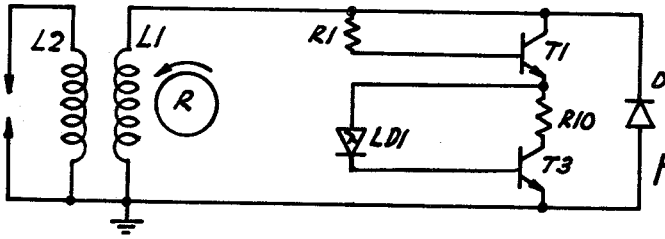
FIG. 18 is a circuit diagram of an embodiment of the ignition circuit of the present invention incorporating a Lambda diode.

FIG. 18 illustrates the circuit diagram of a further embodiment of the ignition circuit of the present invention incorporating a Lambda diode LD1. The magneto and rotor R are as before and the collector-emitter path of the transistor T1 is connected in series with a small resistor R10 and the collector-emitter path of a further transistor T3. The resistor R1 is connected between base and collector of the transistor T1 as before and a Lambda diode LD1 is connected between the emitter of transistor T1 and the base of transistor T3. The diode D5 is connected across the primary winding L1 as before.

During negative voltage pulses produced in the primary winding L1, the diode D5 conducts and the remainder of the circuit remains inactive. However, during positive voltage pulses, as the magnitude of the voltage increases, a small current flows through the resistor R1 and into the base of transistor T1 which enables transistor T1 to begin to conduct. Accordingly a small current flows through transistor T1 through the Lambda diode LD1 and into the base of transistor T3. Thus both transistors T3 and T1 are able to conduct and pass the primary winding current which is of increasing magnitude.

The Lambda diode LD1 senses the voltage across the resistor R10 and the collector-base junction of the transistor T3. As the magnitude of the primary winding current continues to increase, a predetermined current level is reached at which the total voltage drop across the resistor R10 and the collector-base junction of the transistor T3 is sufficient to prevent conduction of the Lambda diode LD1.

Therefore the transistor T3 does not receive any base current and is turned off. In consequence the primary winding current is suddenly interrupted thereby inducing a high voltage in the secondary winding L2 and creating a spark in known fashion as desired. The above-described procedure is repeated for every positive current pulse.

Figure 19:
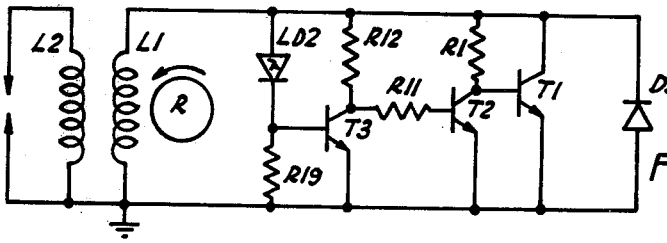
FIG. 19 is a circuit diagram of another embodiment of the present invention incorporating a Lambda diode.

A still further embodiment of the ignition circuit of the present invention is illustrated in FIG. 19 in which transistors T1 and T2, resistor R1 and diode D5 are connected as before. However, a third transistor T3 has its emitter connected to the emitter of transistor T2 and its collector connected to the collector of transistor T1 via a resistor R12. The base of transistor T2 and the collector of transistor T3 are connected via a resistor R11. The base of the transistor T3 is connected to the junction of Lambda diode LD2 and resistor R19.

Again during negative pulses produced in the primary winding L1, the diode D5 conducts and the remainder of the circuit is inactive. However, during each positive pulse produced in the primary winding L1, as the magnitude of the pulse increases a current flows through the Lambda diode LD2 and resistor R19. The voltage drop across resistor R19 is thus applied to the base of the transistor T3. Therefore transistor T3 conducts through resistor R12 and thereby maintains the collector of transistor T3 at a relatively low voltage.

This relatively low voltage is insufficient to cause enough base current to flow through resistor R11 and into the base of transistor T2, to turn transistor T2 on. Therefore transistor T2 does not conduct and sufficient base current flows through resistor R1 and into the base of transistor T1 to enable transistor T1 to conduct. In consequence the primary winding current is primarily conducted through the transistor T1.

However, when the positive voltage pulse induced in the primary winding L1 exceeds a predetermined magnitude, the Lambda diode LD2 ceases to conduct. Therefore transistor T3 does not receive any base current and is thereby turned off. When transistor T3 turns off the potential at the collector of transistor T3 rises and sufficient current flows through the series connected resistors R11 and R12 and into the base of transistor T2 to turn transistor T2 on. As a result the base of transistor T1 is effectively connected directly to the emitter of transistor T1. Therefore as before transistor T1 abruptly ceases to conduct and the current flowing in the primary winding L1 is interrupted as before.

Figure 20:
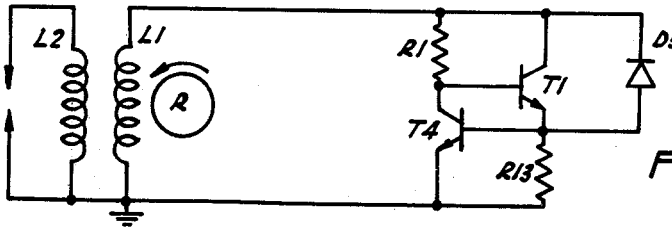
FIG. 20 is a circuit diagram of a still further embodiment of the ignition circuit of the present invention.

FIG. 20 illustrates yet another embodiment of the ignition circuit of the present invention. The circuit comprises a primary winding L1 of a magneto as before having a secondary winding L2. A transistor T1 has its collector-emitter conduction path connected in series with a resistor R13 across the primary winding L1. A resistor R1 is connected between base and collector of the transistor T1 as before. A transistor T4 is connected with its base-emitter junction in parallel with resistor R13 and its collector connected to the base of transistor T1. Diode D5 is directly connected between collector and emitter of transistor T1 as before.

During operation of the rotor R, voltage pulses are induced in the primary winding L1 as before and the negative pulses so induced are clipped by means of the diode D5. However, during the positive pulses, sufficient current flows through resistor R1 to allow transistor T1 to conduct via resistor R13. This situation continues until the current flowing in the primary winding L1 reaches a predetermined value at which time the voltage drop across resistor R13 is sufficient to turn transistor T4 on. As a result the base of transistor T1 is effectively connected to a potential less than that of its emitter. As a result no current flows into the base of transistor T1 and it switches off. Accordingly the current flowing in the primary winding L1 is abruptly interrupted thereby inducing a spark in the secondary winding L2 as desired.

Figure 21:
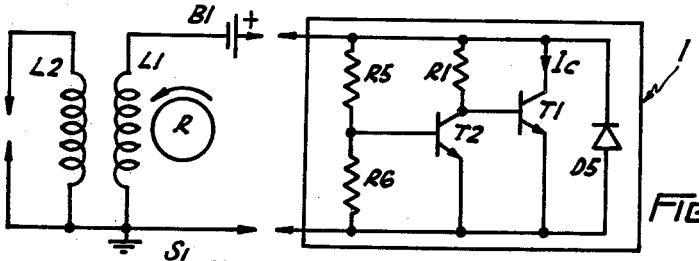
FIG. 21 is a circuit diagram of a modification to any electronic ignition circuit which enables battery assistance at starting and low speed starting to be provided.

FIG. 21 illustrates a modification to any of the circuits illustrated herein including known prior art circuits in which a battery is available to assist during starting so that ignition may be achieved at extremely low rotor revolutions. As shown in FIG. 21 a battery B1 is connected in series with the primary winding L1, the polarity of the battery B1 being such that the pulses of positive current produced by the primary winding L1 are increased in magnitude by current from the battery B1. The result of this effective current increase is that the rotor revolutions required to cause ignition are substantially reduced and lower speed starting is thereby achieved. The ignition circuit indicated generally by the numeral 1 of FIG. 21 may be any one of the magneto transistor ignition circuits illustrated herein including known prior art circuits.

Figure 22:
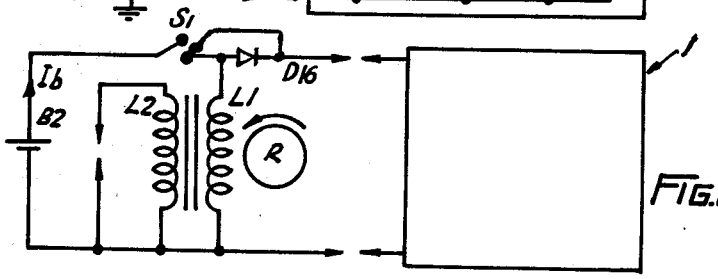
FIG. 22 is another embodiment of the circuit of FIG. 21.

FIG. 22 illustrates an embodiment similar to that of FIG. 21, component 1 being an ignition circuit. As shown in FIG. 22 a battery B2 is connected in series with a switch S1, and the primary winding L1 is connected in series with a diode D16. The switch S1 is operable so as to connect the battery to the ignition circuit 1 only during cranking of the engine and after ignition the switch S1 returns to its normal position in which diode D16 is short-circuited. Therefore during cranking current flows from the battery B1 to the ignition circuit 1 and is available to increase the effective magnitude of the positive current pulse applied to the ignition circuit 1. Diode D16 prevents current flowing from the battery B2 through the primary winding L1. The result of the effective current increase is that the rotor revolutions required to cause ignition are substantially reduced and lower speed starting is thereby achieved.

Figure 23:
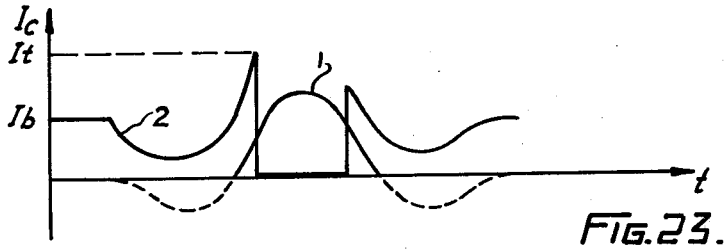
FIG. 23 is a graph of collector current Ic against time for the circuits of FIG. 21 and FIG. 22.

The position is illustrated in FIG. 23 which shows the graph of the collector current Ic (see the detailed circuit of FIG. 21) as a function of time. The curve labeled (1) shows the position when no battery current is applied, the dashed negative portions of the curve representing the primary winding current carried by the diode D5. However, when the battery current Ib is supplied the curve is effectively moved upwards and ignition is achieved with a positive pulse of smaller amplitude since only a small positive pulse is required to increase the total collector current Ic to the level of current, It, which is required to trigger the circuit.

As the level of battery current Ib supplied increases, the starting RPM decreases, which makes the circuit of FIG. 22 ideal for outboard motors, lawn mowers and other applications to which internal combustion engines are put. Since the battery current is only drawn during starting the battery B2 may be a dry cell since large battery ampere-hour capacities are not required. If required the battery may also be a rechargeable battery such as an NiCd or lead-acid battery.

If the battery current in FIG. 21 is increased to the point where it substantially equals the triggering current It, then it is possible to achieve ignition at zero revolutions provided that the piston is properly located in the cylinder relative to top dead centre (TDC). This proper location of the piston can be achieved by ensuring that the flywheel stops each time the engine is used in a predetermined position. This may be achieved by magnetic attraction between a magnet on the flywheel and a magnet on the crankcase. Alternatively the flywheel may be manually turned prior to ignition to locate the flywheel in the desired location. Fuel is injected into the cylinder(s) prior to activating the first spark. The injection of the fuel and the activation of the first spark may be accomplished in that order by a manual, automatic mechanical, or electrical operation.

Figure 24:
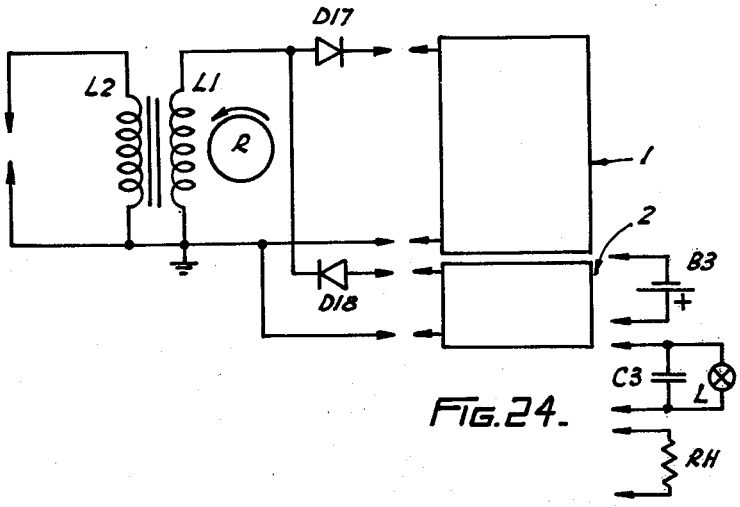
FIG. 24 is a circuit diagram of one embodiment of a modified ignition circuit which enables an electrical load to be driven by the primary winding.

Referring now to FIG. 24 and previous circuits, the current generated in the primary winding L1 which flowed in the negative direction was previously passed through bypass diode D5 and not put to any use. The circuit of FIG. 24 illustrates how the ignition circuit 1 may be isolated by diode D17 and allowed to operate on the positive current pulses it requires whilst a diode D18 allows the negative pulses produced in the primary winding L2 to be transferred and applied to an electrical load 2.

Such a load 2 may constitute the charging of a battery B3 used for any purpose. For example, the battery B3 may be used to power a small guide light located at the end of a manually directed nozzle through which liquid is pumped from a spray pack misting machine carried on the back of an operator and operated by the internal combustion engine having the primary winding L1 in its magneto. Other possible loads include, but are not restricted to, a capacitor C3 connected in parallel with an incandescent lamp L which operates as a pilot light or as the above-described guide lamp. The lamp L may also be operated without the capacitor C3. A heating element RH which may be used to heat the handles and/or carburettor of a chain saw or other engines intended for use in cold climates is an alternative load.

Figure 25:
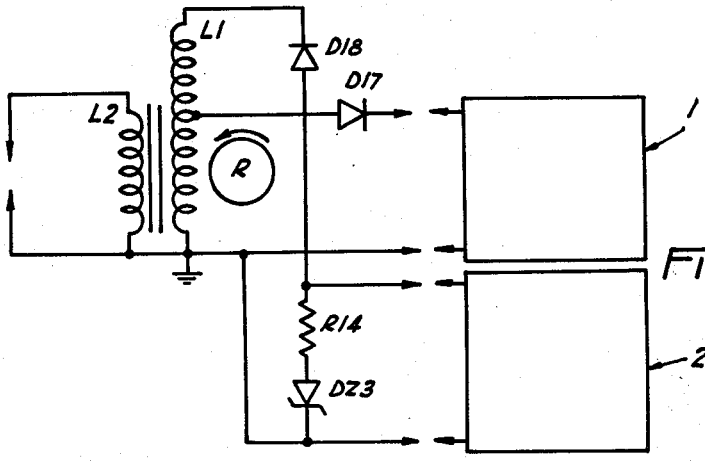
FIG. 25 is a further embodiment of the circuit of FIG. 24.

Referring now to FIG. 25, where the amount of power required for the load 2 is beyond that able to be produced by the negative current pulses induced in the primary winding L1 of FIG. 24, then a larger primary winding L1 of FIG. 24 may be produced and some fraction of the total number of primary turns tapped to provide the necessary effective primary winding for the ignition circuit. However, the negative pulses of current produced by the entire coil are available for operating the load 2. Zener diode DZ3 and resistor R14 are preferments and function to clip the negative voltage pulses at high engine speed and thus protect the load 2.

It is to be understood that the diodes D17 and D18 are merely representative of the possible isolating circuits to separate the ignition circuit 1 from the load 2. For example, the diode D17 could be reversed and placed in the other lead leading from the ignition coil L1 to the ignition circuit.

Figure 26:
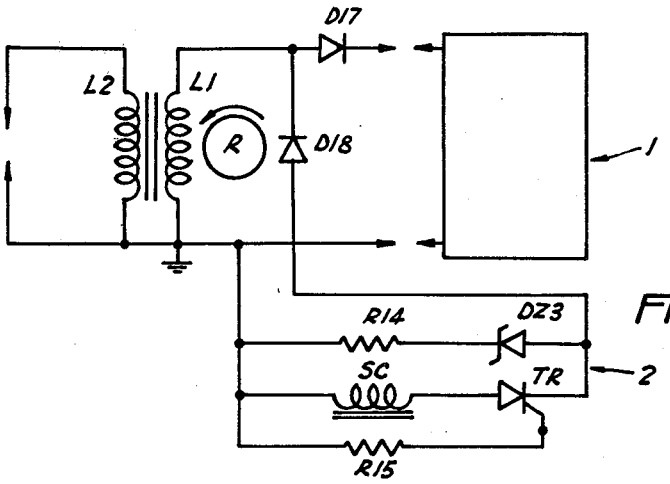
FIG. 26 is a modification to the circuit illustrated in FIG. 24 which enables a chain saw safety brake to be operated from the primary winding.

The circuit shown in FIG. 26 is a modification to the circuit shown in FIG. 24 which enables a chain saw safety brake (or similar mechanical device) to be operated from the primary winding L1. The ignition circuit 1 and diodes D17 and D18 are as illustrated in FIG. 24 whilst the Zener diode DZ3 and resistor R14 are as illustrated in FIG. 25 and function as before.

The electrical load 2 of FIG. 26 comprises a solenoid coil SC connected in series with a silicon controlled rectifier TR. A strain sensitive resistor R15 is connected between the gate of the SCR TR and the solenoid coil SC as illustrated. The strain sensitive resistor R15 is associated with the handle of a chain saw such that, when the handle is grasped by the hand of the operator, the strain applied to the resistor R15 increases its resistance. Accordingly the magnitude of the resistor R15 prevents sufficient gate current flowing into the gate of the SCR TR to cause it to conduct whilst the handle of the chain saw is held by the operator.

However, should the hand of the operator slip from the handle of the chain saw, the resistor R15 is no longer strained and therefore its resistance rapidly decreases. This change in resistance permits a sufficient gate current to flow into the SCR TR which then switches on. As a result the solenoid coil SC receives current from the negative pulses produced in the primary winding L1. When the solenoid coil SC is energized this operates an armature (not shown) which in turn permits the safety brake (not shown) of the chain saw to operate. It will be seen therefore, that should the hand of the operator slip from the handle of the chain saw, the chain saw is immediately braked so as to reduce the likelihood of any injury being sustained by the operator. If desired resistor R15 may be replaced by a pressure sensitive device or used in conjunction therewith.

Figure 27:
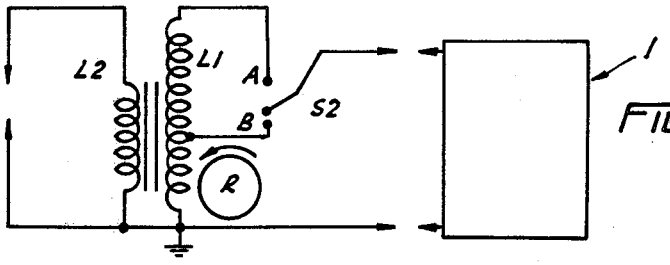
FIG. 27 is a circuit diagram of an embodiment of the present invention in which the primary winding of the ignition coil is selectively tapped in accordance with different engine revolutions.

In FIG. 27 a circuit arrangement is illustrated which enables an ignition circuit 1 having semi-conductor devices with relatively low power and voltage ratings to be used with safety, especially on internal combustion engines designed to run at high revolutions. The problem arises that since the magnitude of the voltage produced in the magneto is substantially proportional to the speed of the rotor, then at high engine revolutions, high voltages may be produced which could damage low cost semi-conductor devices. In order to overcome this problem a tapped primary winding L1 is provided together with a rotor speed sensitive switch S2.

At low engine revolutions the switch S2 connects the ignition circuit 1 to the terminal A of the primary winding L1 so that a maximum of voltage and current is available to secure ignition at low speeds. However, when the speed of the internal combustion engine increases, the speed sensitive switch S2 connects the ignition circuit 1 to a tapped point B on the primary winding L1. The current and voltage generated at the tapped point B are significantly reduced below those generated at A and accordingly the ignition circuit is protected.

The speed sensitive switch S2 may be any type of switch. For example, switch S2 may be a mechanical switch which may conveniently be mounted on the rotor or, alternatively, may be an electrical switch, the operation of which is dependent upon the magnitude of the current or voltage produced by the primary winding L1.

Figure 28:
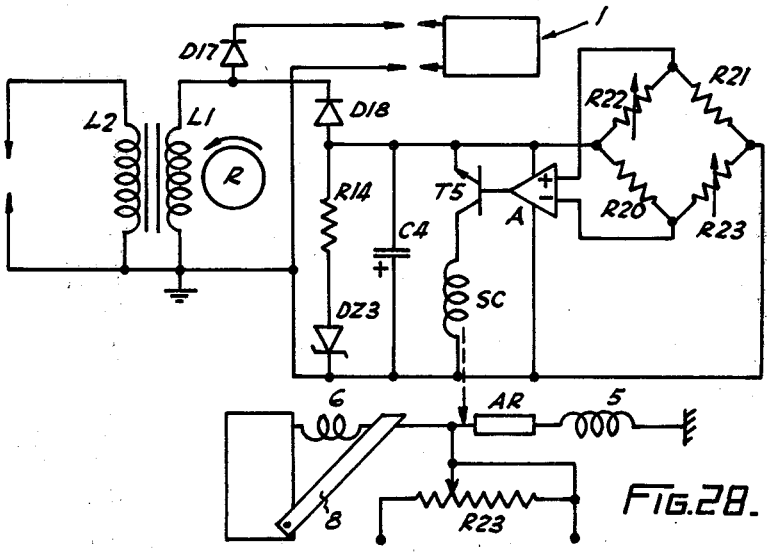
FIG. 28 is a circuit diagram of a further modification to the igntion circuit of the present invention which enables adjustable speed control of the internal combustion engine to be achieved.

The circuit arrangement illustrated in FIG. 28 provides an adjustable constant R.P.M. control system which is powered by the negative pulses produced in the primary winding L1. Diodes D17 and D18 and resistor R14 and Zener diode DZ3 all function as before. A capacitor C4 is connected in parallel with the resistor R14 and Zener diode DZ3 so as to be charged by the abovementioned negative current pulses. Accordingly capacitor C14 provides a filtering action and enables a relatively steady D.C. voltage to be applied across resistor R14 and Zener diode DZ3.

A Wheatstone bridge, comprising resistors R20 and R21 and potentiometers R22 and R23, is connected in parallel with the capacitor C4. A differential amplifier A has its inputs connected to the Wheatstone bridge so as to amplify any out-of-balance voltage produced by the Wheatstone bridge. The power supply for the amplifier A is obtained from the capacitor C4 and the output of the amplifier A is connected to the base of a transistor T5. The collector-emitter conduction path of the transistor T5 is connected in series with a solenoid coil SC across the capacitor C4.

It will therefore be seen that any out-of-balance voltage produced by the Wheatstone bridge will be amplified by the amplifier A and applied to the base of transistor T5 so as to control the current conducted by the solenoid coil SC. When the solenoid coil SC is energized this moves the armature AR to the left as seen in FIG. 28 against the action of a spring 5. The armature AR is also connected to a lever 8 which controls the throttle setting of the carburettor 7 of the internal combustion engine. A spring 6 is connected between the carburettor 7 and lever 8 so as to move the lever 8 towards the carburettor 7.

The desired constant speed at which the engine is required to run is set by adjusting the resistance of potentiometer R22. For a given value of resistance of the potentiometer R22 an out-of-balance voltage will be produced on the Wheatstone bridge and this is voltage applied, via amplifier A, to the transistor T5. Accordingly transistor T5 changes the amount of current flowing in the solenoid coil SC so as to move the armature AR, and hence lever 8, to alter the throttle setting of the carburettor 7. As a result the speed of the engine changes as does the resistance value of potentiometer R23. Both these changes reduce the out-of-balance voltage produced by the Wheatstone bridge and accordingly a feedback loop is established.

It will be seen that any change in the operating conditions of the engine results in a change in engine speed which is sensed by the Wheatstone bridge. The above-described circuit accordingly operates to change the position of the lever 8 and the resistance of potentiometer R23 so as to return the engine speed to the desired preset speed.

Figure 29:
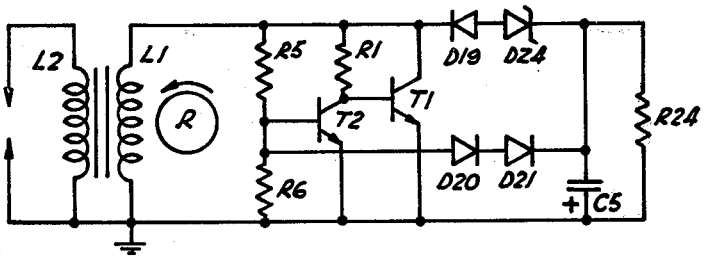
FIG. 29 is a circuit diagram of another modification of the ignition circuit of the present invention which prevents a maximum engine revolution rate being exceeded.

FIG. 29 illustrates an embodiment of the present invention which enables the ignition circuit to include a governor which prevents the engine revolutions exceeding a predetermined level. In the circuit of FIG. 29 the resistors R1, R5 and R6 and transistors T1 and T2 function as before in relation to the positive voltage pulses produced in the ignition coil L1.

As engine revolutions increase the magnitude of the negative voltage pulse produced in the primary winding L1 increases and at a predetermined negative voltage pulse magnitude the Zener diode DZ4 will be overcome to permit the capacitor C5 to be charged via the Zener diode DZ4 and diode D19. The resistor R24 connected in parallel with the capacitor C5 discharges the capacitor C5 at a predetermined rate. As engine revolutions continue to increase the capacitor C5 will progressively become more charged, notwithstanding the action of resistor R24, until such time as the capacitor C5 is sufficiently charged to forward bias diodes D20 and D21. As a result the potential appearing at the junction of resistors R5 and R6 and the base of transistor T2 is lowered thereby preventing transistor T2 from being turned on as the first step in causing ignition.

Once diodes D20 and D21 have been forward biassed the next positive pulse produced by the ignition coil L1 will cause a current to flow through resistor R5, and diodes D20 and D21 to discharge the capacitor C5 partially. Accordingly one or more engine cycles will be completed without any ignition taking place and the engine revolutions will decrease. The engine revolutions will continue to decrease until the magnitude of the negative voltage pulse is insufficient to overcome Zener diode D24 and charge capacitor C5. Therefore diodes D20 and D21 will no longer be forward biassed and ignition will recommence.

It will therefore be seen that the circuit of FIG. 29 prevents the engine revolutions exceeding a predetermined revolution rate and this rate may be adjusted by changing the resistance of resistor R24, and/or the capacitance of capacitor C5, and/or by selecting Zener diode DZ4 to have a different reverse breakdown voltage.

Figure 30:
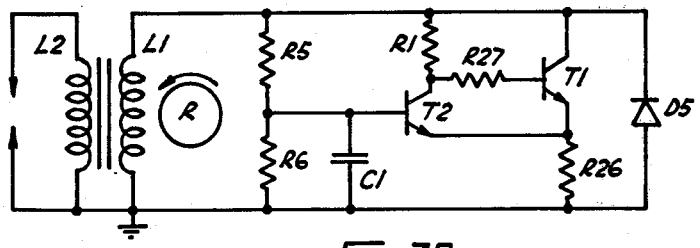
FIG. 30 is a circuit diagram of yet another embodiment of the ignition circuit of the present invention which incorporates a Schmitt Trigger.

FIG. 30 is a circuit diagram of a Schmidt Trigger embodiment of the ignition circuit of the present invention. It will be seen that a resistor R26 is connected between the emitter of transistor T1 and the primary winding L1 whilst a resistor R27 is connected between the base of transistor T1 and the collector of transistor T2. The emitter of transistor T2 is connected to the emitter of transistor T1 as before.

During negative cycles of the voltage produced in the primary winding L1, diode D5 functions as before. However, during positive cycles of the induced primary winding voltage, resistors R1 and R27 supply sufficient base current to transistor T1 to permit transistor T1 to conduct. Therefore as transistor T1 conducts the increasing pulse of positive current, so the voltage across resistor R26 progressively increases. When the voltage at the junction of resistors R5 and R6 has increased sufficiently above the voltage appearing across resistor R26, base current begins to flow into transistor T2 which begins to turn on.

As transistor T2 begins to turn on, the base current flowing into the transistor T1 is now partially diverted and flows through transistor T2. Accordingly transistor T1 begins to turn off and the amount of current flowing between collector and emitter of transistor T1 is reduced. As this current reduces so the voltage across resistor R26 is also reduced thereby increasing the voltage applied between base and emitter of transistor T2. This increase in base-emitter voltage turns transistor T2 on more strongly, thereby diverting more base current from transistor T1 and turning transistor T1 off more quickly.

It will be seen that a regenerative effect quickly takes place in which the reducing current flowing between connector and emitter of transistor T1 acts to turn transistor T2 on more strongly, thereby further reducing the current flowing between collector and emitter of transistor T1. As a result the turn off time of transistor T1 is decreased and a more abrupt interruption to the primary winding current is achieved. Such an abrupt interruption is desirable since it assists in inducing a high voltage spark in the secondary winding of L2 of the magneto.

Figure 31:
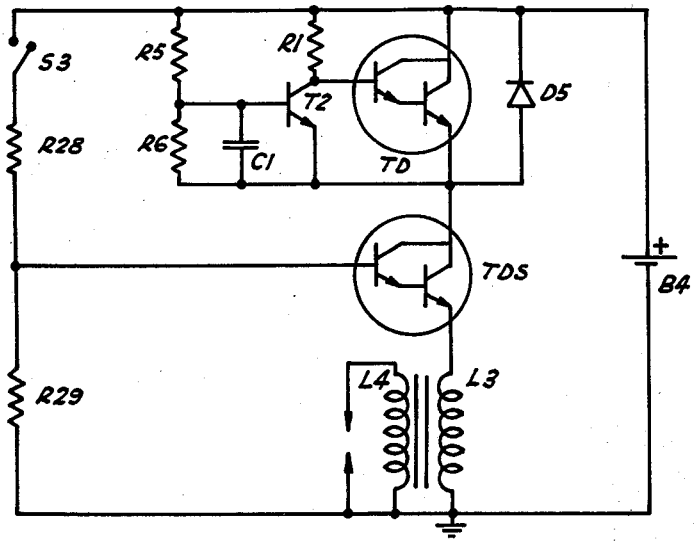
FIG. 31 is a circuit diagram illustrating how the ignition circuit of the present invention is used for internal combustion engines having a battery rather than a magneto ignition system.

As mentioned previously the ignition circuit of the present invention is not limited to use with internal combustion engines having a magneto, but rather may also be used with internal combustion engines which have a battery ignition system such as that commonly used in automobiles. FIG. 31 illustrates an embodiment of the ignition circuit of the present invention when used with internal combustion engines having a battery ignition system.

The circuit of FIG. 31 comprises the battery B4 of the battery ignition system connected in series with the primary winding L3 of a battery ignition coil assembly. The primary winding L3 is connected in series with a switch, which in the preferred embodiment comprises a switching Darlington transistor TDS. Finally the switching Darlington transistor TDS is connected in series with the ignition circuit of the present invention to complete the primary winding current path via the battery B4.

The primary winding L3 has a secondary winding L4 magnetically coupled thereto in conventional fashion. Series connected resistors R28 and R29 are connected in series with a switch S3 across the battery B4. The switch S3 closes in synchronism with engine revolutions and may be either a mechanical switch, a hall effect device, a light sensitive switch, or some other switching device. The base of the switching Darlington transistor TDS is connected to the junction of resistors R28 and R29. Resistors R28 and R29 are selected such that when switch S3 is closed the switching Darlington transistor TDS turns on and permits conduction of primary winding current.

As switching Darlington transistor TDS turns on, the Darlington transistor TD begins to conduct since sufficient base current flows through resistor R1 into the base of Darlington transistor TD and then through switching Darlington transistor TDS and primary winding L3. Therefore Darlington transistor TD conducts without going into saturation and allows primary winding current to flow from the battery B4 through Darlington transistor TD, switching Darlington transistor TDS and primary winding L3. Some of the primary winding current is diverted to flow through resistors R5 and R6 and therefore, as before, when the potential at the base of the transistor T2 increases sufficiently, transistor T2 turns on to turn Darlington transistor TD off.

When Darlington transistor TD turns off the primary winding current is interrupted thereby producing a high secondary induced voltage as desired. The timing of switch S3 is such that when the Darlington transistor TD has interrupted the primary winding current, then switch S3 opens so as to disconnect the bias circuit formed from resistors R28 and R29 for the switching Darlington transistor TDS. Accordingly to the switching Darlington transistor TDS turns off.

This cycle is then repeated for as switch S3 closes, switching Darlington transistor TDS turns on, Darlington transistor TD conducts and then interrupts primary winding current and finally switch S3 re-opens so as to turn switching Darlington transistor TDS off.

If desired, a potentiometer or resistor could be connected in parallel with switching Darlington transistor TDS to allow a current less than the triggering current to flow in the primary winding L3 before switch S3 closes. When switch S3 closes the primary winding current quickly exceeds the trigger current thereby quickly causing ignition. In this way reliable ignition at high engine revolutions may be obtained.

The ignition circuits of the present invention have been fabricated using thick film hybrid integrated techniques which result in circuits of small physical size. Preferably the thermistors illustrated in FIG. 8 are formed on the same substrate as that on which the transistor T1 or Darlington transistor TD is formed. In this way the thermistors act very quickly immediately there is any change in the substrate temperature. The abovementioned construction of the ignition circuits of the present invention enables the ignition circuit to be moulded together with the magneto or ignition coil and in very close proximity thereto.

It is also to be understood that the circuits described above using NPN transistors may be modified to use, for example, PNP transistors with attendent changes in polarity.

Since all the circuits described above will operate from conventional magneto coil assemblies, the above description of the present invention has been directed to the circuit details of the present invention. However, the performance of the above-described circuits, when operated from conventional magneto coil assemblies normally used for mechanical ignition breaker points, may be improved when operated from the magneto coil assemblies of the present invention.

Figure 32:
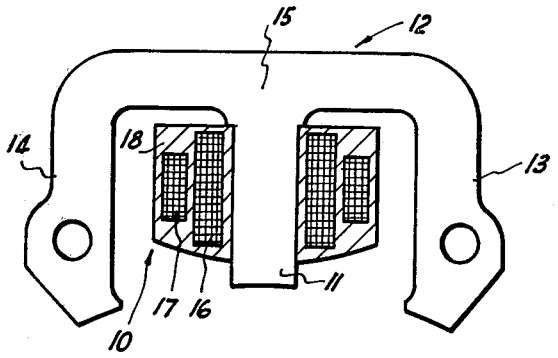
Figure 33:
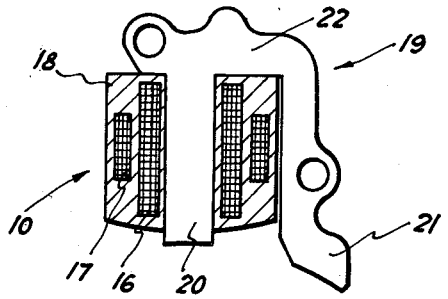
Figure 34:
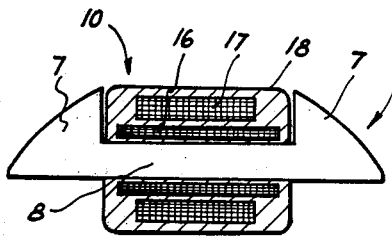
Figure 35:
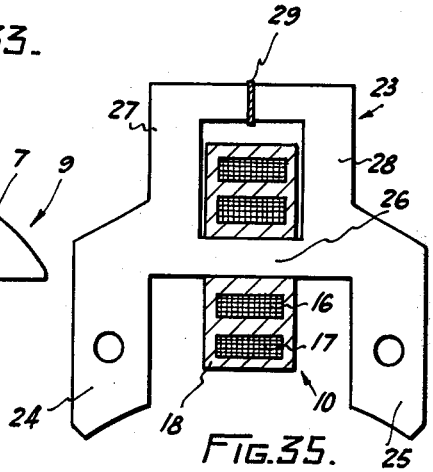
Figure 36:
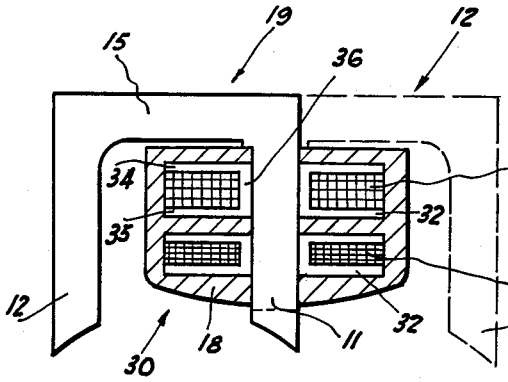
Figure 37:
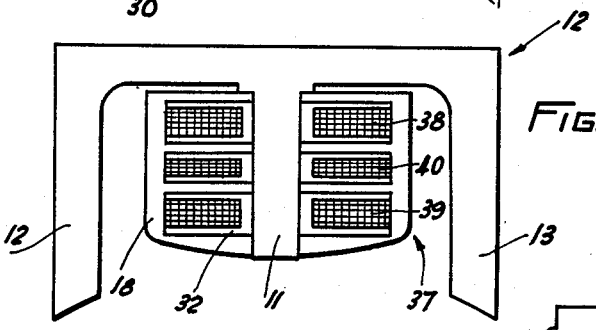
Figure 39:
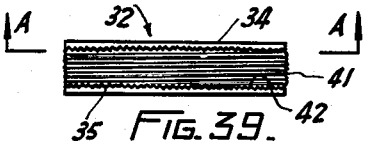
Figure 38:
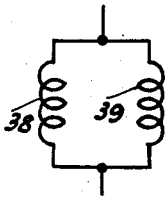
Figure 41:
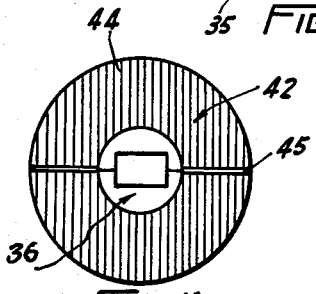
Figure 40:
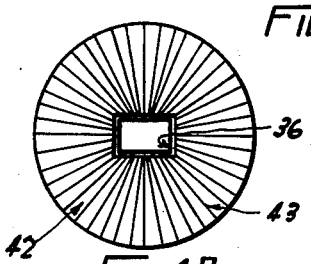
Figure 42:
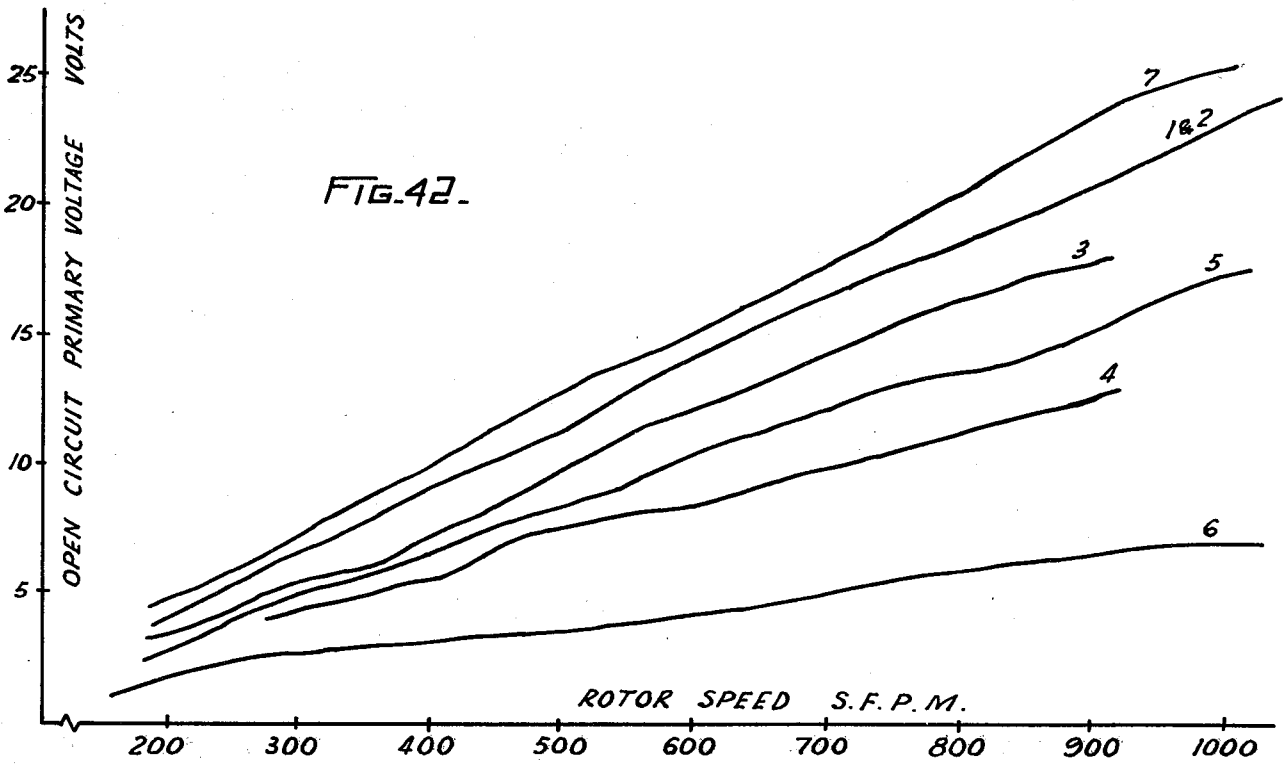
Figure 43:
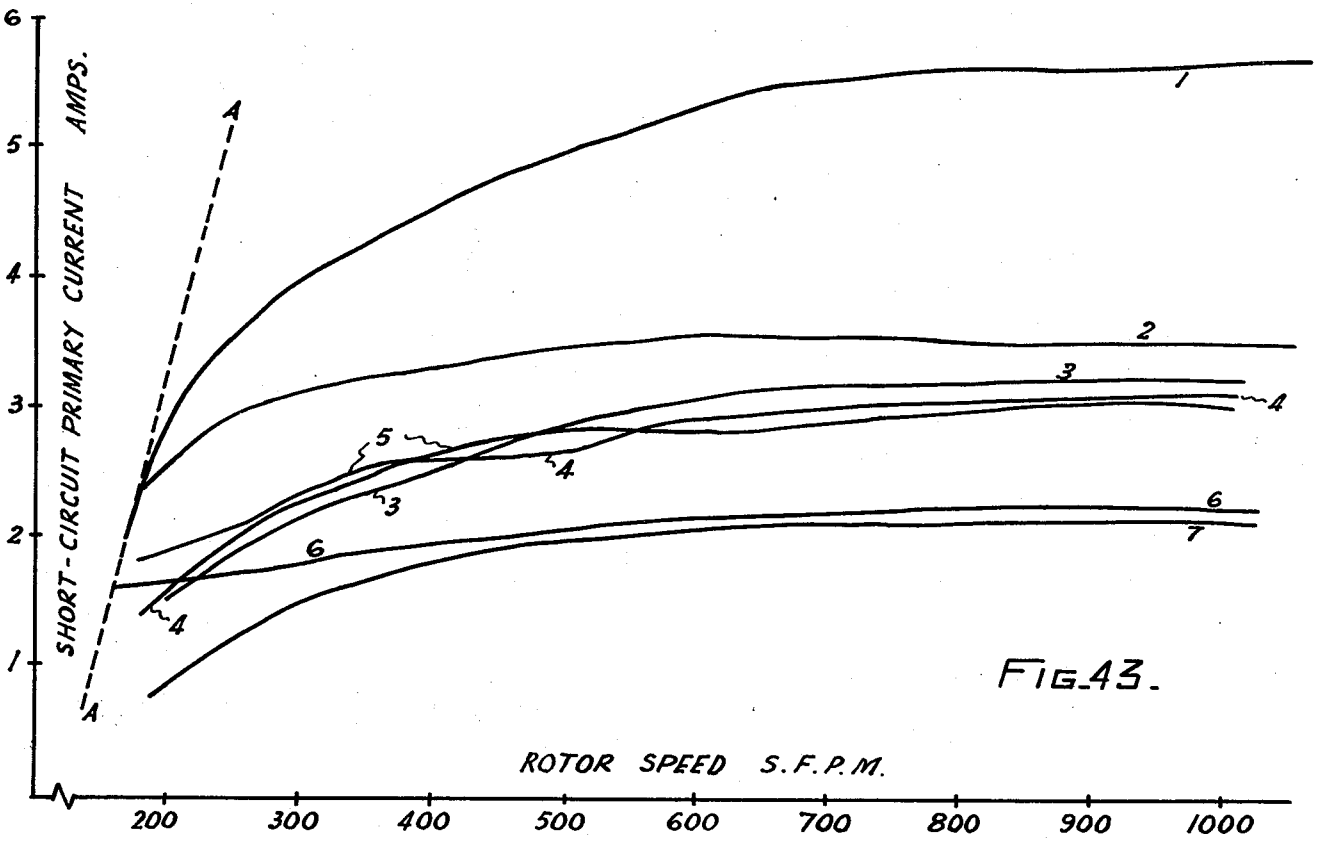
Figure 44:
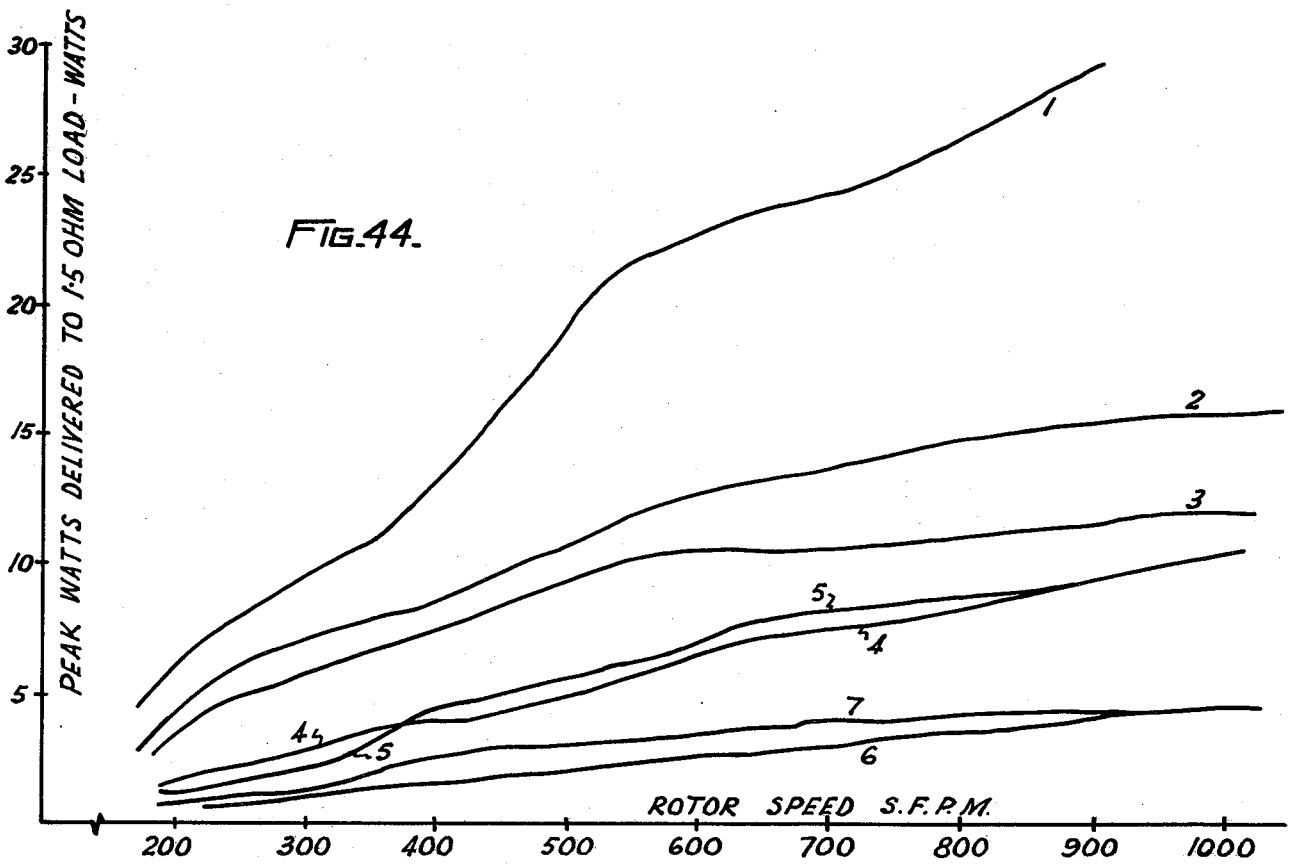

The magneto coil assemblies of the present invention will now be described in more detail with reference to the drawings in which:

FIG. 32 is a cross-sectional view of a conventional magneto coil assembly having a 3-legged permeable core;

FIG. 33 is a cross-sectional view of a conventional magneto coil assembly having a 2-legged permeable core;

FIG. 34 is a cross-sectional view of a conventional magneto coil assembly having an I-shaped permeable core;

FIG. 35 is a cross-sectional view of a conventional magneto coil assembly having a 2-legged permeable core with encompassing core limbs;

FIG. 36 is a cross-sectional view of the magneto coil assembly of a first embodiment of the present invention suitable for either 1, 2 or 3-legged permeable cores;

FIG. 37 is a cross-sectional view of the magneto coil assembly of a second embodiment of the present invention also suitable for either 1, 2 or 3-legged permeable cores;

FIG. 38 is a circuit diagram showing the preferred interconnection of the primary windings illustrated in FIG. 37;

FIG. 39 is a side elevation of an embodiment of a coil carrying spool of the present invention;

FIG. 40 is a cross-sectional view of the spool of FIG. 39 taken along the line AA of FIG. 39;

FIG. 41 is a cross-sectional view similar to FIG. 40 of a spool of a second embodiment;

FIG. 42 is a graph of peak open-circuit primary voltage vs rotor speed characteristic of an embodiment of the magneto coil assembly of the present invention when compared with known magneto coil assemblies;

FIG. 43 is a graph of the peak short-circuit primary current vs rotor speed characteristic of the abovementioned coil assemblies; and FIG. 44 is a graph showing the peak watts delivered by the abovementioned coils to a 1.5 ohm resistive load as a function of rotor speed.

The cross-sectional view of FIG. 32 shows a conventional magneto coil assembly configuration comprising magneto coils 10 mounted on the centre leg 11 of a 3-legged permeable core 12 which is normally formed from a plurality of steel laminations. The core 12 has a centre limb 11 and outer legs 13 and 14, which are interconnected by means of a cross member 15. The centre limb 11, cross member 15 and any one of the outer limbs 13 and 14 surround the magneto coils 10 on three sides thereof.

The magneto coils 10 themselves comprise a primary winding 16 normally having from 200 to 300 windings of relatively thick wire. The primary winding 16 is normally rectangular or square in cross-section and its longer side extends along the centre limb 11. Coaxial with and spaced from the primary winding 16, is a secondary winding 17 which is also normally rectangular or square in cross-section. The diameter of the secondary winding wire is very much less than that used in the primary winding and typically has a diameter of only about 0.002 inches. In addition the secondary winding 17 generally contains of the order of 10,000 turns. The primary winding 16 and secondary winding 17 are normally encased within a moulded body 18 which is normally formed from epoxy resin, low density PVC or any other like material.

FIG. 33 is a view similar to that of FIG. 32 but illustrates a magneto coil assembly in which conventional magneto coils 10 are mounted on a 2-legged permeable core 19. Again the permeable core 19 is normally formed from a a plurality of steel laminations and comprises an inner leg 20 upon which the magneto coils 10 are mounted and an outer leg 21. The legs 20 and 21 are joined by a cross member 22. The magneto coils 10 comprise a primary winding 16, a secondary winding 17 and a moulded body 18 as before. As in FIG. 32, the permeable core 19 illustrated in FIG. 33 only surrounds the magneto coils 10 on three sides thereof. The magneto coils 10 of FIGS. 32 and 33 are sometimes mounted on cross member 15 or 22 respectively rather than inner legs 11 or 20.

In FIG. 34 a further conventional magneto coil assembly is illustrated. However, the permeable core 9 comprises a cross member 8 upon which the coils 10 are mounted and part-circular side members 7. The assembly of FIG. 34 is intended for location at a fixed position within the interior of an annular rotor whilst the assemblies of FIGS. 32 and 33 are intended for location at a fixed position external to the rotor.

FIG. 35 is again a cross-sectional view of a conventional magneto coil assembly manufactured by Briggs & Stratton. The magneto coils 10 have a primary winding 16, secondary winding 17, and moulded body 18 as before and are mounted on an encompassing permeable core 23 which is again normally formed from a plurality of steel laminations.

The encompassing permeable core 23 comprises first and second legs 24 and 25 respectively joined by a mounting limb 26 which carries the magneto coils 10. The first leg 24 and second leg 25 are respectively extended to form L-shaped limbs 27 and 28 which substantially enclose the magneto coils 10. The extremities of the L-shaped limbs 27 and 28 abut either side of a thin shim 29 of non-magnetic material. It will be apparent from FIG. 35 that the permeable core 23 by virtue of mounting limb 26 and L-shaped limbs 27 and 28, substantially encompasses the magneto coils 10 on four sides thereof. For this reason the configuration of the encompassing permeable core 23 is to be contrasted with the configuration of the permeable cores 9, 12 and 19.

In conventional magneto coil assembly practise it is also known, where space immediately adjacent the magneto rotor is limited, to locate one of the above-described magneto coil assemblies away from the immediate vicinity of the rotor. In this case a first winding and associated permeable core is located adjacent to the rotor. The first winding is directly connected across the primary winding of the magneto coil assembly. This arrangement is also within the scope of the present invention.

The cross-sectional view of FIG. 36 shows the magneto coils 30 of a first embodiment of the present invention which may be mounted on either the 3-legged permeable core 12 of FIG. 32, or the 2-legged permeable core 19 of FIG. 33. The outer leg 13 of FIG. 36 is drawn with broken lines to indicate this alternative permeable core arrangement. The permeable core configuration of FIG. 34 may also be used.

The magneto coils 30 themselves comprise a primary winding 31 mounted in a spool 32 and a secondary winding 33 mounted in a similar spool 32. Both the primary winding 31 and the secondary winding 33 have substantially rectangular cross-sectional areas, however, in both cases the shorter cross-sectional coil dimension extends along the centre limb 11.

The spools 32 may be fabricated from any convenient nonmagnetic material and are of generally toroidal shape having upper and lower discs 34 and 35 respectively spaced apart by a central channel portion 36. The channel portion 36 may have the same internal cross-section as the cross-section of the centre limb 11, as illustrated, or have a circular interior for ease of manufacture.

The spacing between the upper disc 34 and lower disc 35 of the spool 32 carrying the primary winding 31 will normally exceed the corresponding spacing for the spool 32 carrying the secondary, winding 33. Although the spools 32 illustrated in FIG. 36 have substantially equal external diameters, the external diameters of the spools 32 carrying the primary winding 31 and secondary winding 33 may be different if desired. The spools 32 carrying both windings 31 and 32 are preferably encased within a moulded body 18 as are the conventional coils of FIGS. 32 to 35.

In addition the spools 32 may be located on the cross members 15, 22, or 8, rather than the centre limb 11, if desired.

FIG. 37 illustrates a second embodiment of the magneto coil assembly of the present invention in a view similar to that of FIG. 36. The 3-legged permeable core 12 is illustrated for convenience but the 2-legged permeable core 19 or I-shaped core 9 could be used if preferred. The magneto coils 37 of FIG. 37 comprise 3 windings namely first and second primary windings 38 and 39 respectively between which is located a secondary winding 40. The windings 38, 39 and 40 are each carried on a spool 32 as before. The primary windings 38 and 39 are preferably connected in parallel as illustrated in the circuit diagram of FIG. 38. However, if desired, the first and second primary windings 38 and 39 may be connected in series.

In addition, a single winding (either primary or secondary) may be located within two or more spools. In this way the distance between the discs 34 and 35 may be reduced. Thus the voltage appearing between each layer of the coil is reduced since the number of turns per layer has been reduced. This winding technique therefore reduces the insulation requirements of the winding. If desired, a number of spools may be integrally formed.

A side elevation of one of the spools 32 shown in FIG. 36 or 37 is illustrated in FIG. 39 which shows the strands 41 of the secondary winding and also shows the edge of the grooved inner surface 42 of both discs 34 and 35.

The nature of the grooved inner surface 42 may be better seen in FIG. 40 which is a cross-sectional view of the spool 32 of FIG. 39 taken along the line AA. In this embodiment the grooved surface 42 has a plurality of radial grooves 43 substantially equally angularly spaced around the disc. The function of the grooves 43 is to permit epoxy resin to be introduced into the strands 41 of the winding and between the strands 41 and the discs of the spool 32. The grooves 43 allow epoxy resin or a flowable insulating material to permeate into the interior of the winding in order not only to secure the strands 41 of the winding but also to assist in the electrical insulation of the winding. Because the insulation requirements of the primary winding(s) are less severe, the grooved surface 42 may be smooth for the spool 32 carrying the primary windings 31, 38 or 39.

FIG. 41 shows a second embodiment of the grooved inner surface 42 of the spool discs and is a view similar to FIG. 40. FIG. 41 illustrates a grooved inner surface 42 having substantially parallel grooves 44. The parallel grooves 44 are easier to construct than the radial grooves 43 of FIG. 40 since although the spools 32 are normally moulded from plastics material, a mould or die has to be fabricated. In the fabrication of such a mould or die, it is easier to make a series of parallel ridges which will ultimately produce the parallel grooves 44, rather than construct a series of radial ridges which will ultimately produce the radial grooves 43. Use of the parallel grooves 44 does, however, require the presence of a ridge 45 extending substantially perpendicularly to the grooves 44 across the inner surface 42. The ridge 45 is required to prevent the strands 41 forming the coil from lodging in the grooves 44 whilst the coil or winding is being wound.

The channel portion 36 may have a rectangular exterior cross-section as illustrated in FIG. 40 or a circular exterior cross-section as illustrated in FIG. 41. The latter cross-section is preferred since it enables a constant tension to be maintained on the wire whilst the coil is being wound.

The advantages of the magneto coil assemblies described in FIGS. 36 to 41 relate both to the performance and quality of the coils and also to the cost of their manufacture.

The spools 32 may be easily moulded from plastics material and the desired winding would therein. The winding and spool may then be stored ready for assembly as required without the need for an outer coil to be wound around a former which already includes an inner coil. In addition the separate spool construction enables additional insulation such as interleaved sheets of paper, polyester, or the like between layers of the high voltage secondary winding 17, to be removed without any reduction in the effective insulation performance of the coil. The ability to rely for insulation solely upon the enamel covering of the wires in the winding, not only reduces the component cost of producing the coil concerned, but also reduces the amount of time required to wind the coil.

Furthermore the physical size of such a winding without paper of insulation interleaving is reduced. Accordingly the self-capacitance of the winding is reduced and this reduction improves the electrical characteristics of the coil.

It is to be understood that the winding carrying spools of the present invention may be used in addition to conventional windings, if desired, and also may be located coaxially with other windings as the conventional coaxial windings of FIGS. 32, 33, 34 and 35. For example, a conventional primary winding 16 may have a spool 32 located coaxial with it and exterior to it, the spool 32 carrying the secondary winding.

The problems associated with mechanical breaker point ignition systems have resulted in the development of electronic ignition systems such as that described in U.S. Pat. No. 3,878,452 and assigned to Robert Bosch G.m.b.H. This electronic ignition system is commercially available as a Bosch electronic ignition circuit type 525 1/217/280/032 and has a Bosch magneto ignition coil assembly tape 523/60 2204/222/053 which comprises primary and secondary windings designed specifically for the ignition circuit. The lastmentioned Bosch magneto ignition coil assembly is associated with a magneto rotor having a diameter of 3.3125 inches.

When the abovementioned Bosch electronic ignition circuit and magneto ignition coil were both fitted to a Husqvarna brand chain saw, a magneto rotor speed of the order of 1,100 R.P.M. was required to start the motor. At speeds below this figure the motor would not start. For the stated diameter of the magneto rotor and the stated starting magneto rotor revolutions this corresponds to a surface speed for the magneto rotor at starting of 955 surface feet per minute.

However, when the circuit of FIG. 3 was connected to replace the abovementioned Bosch electronic ignition circuit, the same engine started at 350 R.P.M. which corresponds to a surface rotor speed of 304 surface feet per minute. It will therefore be seen that the ignition circuit of the present invention considerably improves the starting speed of the engine even when used with the magneto coil assembly manufactured by Bosch.

When the preferred embodiment of the magneto coil assembly of the present invention, to be described in more detail hereinafter, was used in a test apparatus in combination with the abovementioned known Bosch electronic ignition circuit, the performance of the electronic ignition circuit was also improved. In this case the diameter of the magneto rotor was 6.563 inches and the abovementioned Bosch electronic ignition circuit first produced a spark from the coil secondary winding at 300 R.P.M. which corresponds to 516 surface feet per minute for the rotor concerned. The magnitude of the spark voltage was adequate for engine ignition. It will therefore be seen that the preferred embodiment of the magneto coil assembly of the present invention considerably improves the performance of the abovementioned Bosch electronic ignition circuit also.

Furthermore when the abovementioned magneto coil assembly of the preferred embodiment of the present invention is used with the abovementioned circuit of FIG. 3 then a spark is first produced at 150 R.P.M. which corresponds to a surface speed of 258 surface feet per minute for the same 6.563 inch diameter rotor. Again the magnitude of the spark voltage was adequate for engine ignition. Therefore the combination of the coil assembly of the preferred embodiment and the circuit of the preferred embodiment clearly produces a very superior result in that starting occurs at 150 R.P.M. for a moderately sized rotor which is a very low starting speed indeed.

Although the abovementioned rotor revolutions have been converted into rotor surface speeds for the purposes of comparison and further details of performance to be given hereinafter are also quoted in terms of rotor surface speed, it is to be understood that the physical construction method, overall size and application to which the internal combustion engine is to be put, preclude the use of large diameter magneto rotors in order to get high rotor surface speeds for low engine revolutions. For example, the rotor of a magneto designed for use in a hand-held chain saw typically has a diameter in the vicinity of 3 to 5 inches and it is not a practical proposition to "halve" the starting speeds of conventional ignition systems by "doubling" the diameter of the magneto rotor in order to achieve a high rotor surface speed.

In the above-described tests the secondary voltage produced by the Bosch coil assembly when triggered by the Bosch circuit at 1,100 R.P.M. was 19 kV whereas the secondary voltage produced by the coil assembly of the preferred embodiment of the present invention when triggered by the abovementioned Bosch circuit at 300 R.P.M. was 12.5 kV. Both the Bosch coil assembly and the coil assembly of the preferred embodiment of the present invention produced a secondary voltage of 10 kV, at 350 and 150 R.P.M. respectively, when triggered by the circuit of the preferred embodiment of the present invention. However, a secondary voltage of 10 kV is an entirely adequate secondary voltage, will operate most internal combustion engines under most conditions, and forms a convenient laboratory reference standard. In addition the secondary voltages created with the coil assembly of the preferred embodiment increase more slowly with increasing engine running speeds than do conventional coil assemblies. A small increase is desirable since it protects the coil assembly from possible insulation breakdown caused by corona discharge.

The coil assembly of the preferred embodiment of the present invention was compared with the coil assemblies produced by other manufactures which are set out in Table I hereto. The coil of the preferred embodiment is labeled coil No. 1 in Table I and the abovementioned Bosch coil is labeled No. 3. Only these coils were manufactured specifically for use with an electronic ignition circuit which does not include mechanical breaker points, whilst the remaining coils were all manufactured for use with conventional ignition systems.

The meaning of the heading for each column of Table I is as follows.

Np—the number of turns in the primary winding of the coil.

Dp—the diameter in decimals of an inch of the wire used in the primary winding.

Lp—the inductance of the primary winding in milli-Henries measured at 40 Hz.

Rp—the resistance of the primary winding in ohms.

Ns—the approximate number of turns in the secondary winding of the coil.

Ds—the diameter in decimals of an inch of the wire used in the secondary winding of the coil.

Rd—the diameter of the rotor in inches.

R.P.M./S.F.P.M.—the number of magneto rotor revolutions per minute for each surface foot per minute of rotor surface speed.

Ma—the area in inches of the magnetic pole(s) of the rotor in inches squared. Note that the dimensions given are chord distances and not distances along the curved surface of the rotor. The number in brackets is the number of separate magnets in the rotor.

La—the cross-sectional area in inches squared of the leg or member of the permeable core upon which the primary and secondary windings were mounted.

All the coils with the exception of coil No. 6, manufactured by Briggs and Stratton, were coils of standard configuration wound on a permeable core as illustrated in FIGS. 32, 33 or 34. However, coil No. 6 manufactured by Briggs and Stratton was of the configuration illustrated in FIG. 35. The air gap between the magneto rotor and coil core for all examples was approximately 0.010 to 0.008 inches.

Turning now to FIG. 42 of the drawings, shown therein is a graph of the peak open-circuit primary voltage of each of the coils listed in Table I against the rotor speed in surface feet per minute of the corresponding rotor. It will be observed that each such graph of peak open-circuit primary voltage is substantially proportional to the rotor speed, as is to be expected, and that the characteristic of coils Nos. 1 and 2 are substantially identical and similar to the other characteristics.

However, whilst the peak short-circuit current characteristics illustrated in FIG. 43 of the drawings for coils Nos. 2 to 7 listed in Table 1, are similar and produce a saturation short-circuit primary current in the vicinity of 2 to 3 Amps, the peak short-circuit primary current characteristic of the coil of the preferred embodiment, No. 1, is markedly different from the other characteristics.

In particular the saturation current of the coil of the preferred embodiment of the present invention is in excess of 5 Amps which is approximately twice that of the other coils. Thus if the coil of the preferred embodiment were used with mechanical breaker points, the points would be burnt out very quickly because of excessive current. In addition the change in short-circuit primary current for coil No. 1 for a given change in rotor speed, at low rotor speeds, is very much greater for coil No. 1 than it is for the remaining coils. This may be easily seen by considering the gradient of the tangent line AA shown in FIG. 3. This tangent has a slope which corresponds to a change in short-circuit primary current of approximately 40 mA for every unit surface foot per minute change in the rotor surface speed. Similar tangents for the curves of coils Nos. 2 to 7 have slopes which are only approximately one-half the slope of the line AA of FIG. 43. The high rate of change of short-circuit primary current with change in rotor speed of the coil of the preferred embodiment is particularly advantageous in starting internal combustion engines at low revolutions since a high rate of change of primary current is required to produce a high rate of change of flux in the coil and hence a secondary voltage of sufficient magnitude to create a spark.

As mentioned previously when the magnets in the rotor pass the coil a voltage pulse is generated within the coil. FIG. 42 illustrated the magnitude of the positive peak of the voltage pulse as a function of rotor speed. However, FIG. 44 illustrates the peak power delivered to a 1.5 ohm resistor directly connected across the primary winding as a function of rotor speed. This peak power has been calculated by measuring the peak of the voltage pulse appearing across the 1.5 ohm resistor, squaring this value and then dividing by the resistance.

It will be seen that the peak power produced by the coil of the preferred embodiment exceeds that produced by the other coils for all rotor speeds and that the rate of change of power produced by the coil of the preferred embodiment for a given change in rotor speed is in excess of that produced by the other coils for all rotor speeds.

Consideration of the various values given for the coils listed in Table I indicates that with the exception of coil No. 6, the inductance of the primary winding of the coil of the present invention is considerably less than the corresponding inductances of the other coils. Coils 2 to 5 all have approximately 200 turns in the primary winding and inductances ranging between just over 3 to just under 4 mH. However, the coil of the preferred embodiment has only 140 turns in the primary winding but a considerably reduced inductance of only 2 mH. It is apparent that coil No. 6 manufactured by Briggs and Stratton also has a primary winding inductance of 2 mH, however, this coil only has 75 turns in the primary winding.

It is generally accepted that for coils having substantially the same physical construction and size, the inductance of the coil is proportional to the number of turns in the coil squared. Clearly since coil No. 1 has approximately twice the number of primary winding turns but its inductance is the same as and not four times the inductance of coil No. 6, then the different permeable core arrangement for coil No. 6 clearly influences the inductance measurement. However, consideration of FIGS. 42, 43 and 44 clearly establishes that coils 1 and 6 are markedly different in their properties notwithstanding the fact that the primary windings of the coils have the same inductance.

It is believed that the inductance plays a part in the effectiveness of the coil when used with semi-conductor ignition systems. From a consideration of FIG. 6 it will be seen that the voltage appearing across the primary winding increases very dramatically in a short space of time, to the switched voltage Vs, at the moment that the current flowing in the primary winding is interrupted. Since this interruption takes place with a semi-conductor device, it is important that, when the interruption is intended to occur, in fact the primary winding current does cease to flow.

The magnitude of the peak voltage Vs is believed to be determined by the product of the inductance of the primary winding and the rate of change of primary winding current. Therefore if the primary winding has a large inductance this will produce a large magnitude for the switched voltage Vs.

The collector-emitter conduction path of any transistor device connected in series with the primary winding and acting as a switch essentially comprises 2 semi-conductor diodes back-to-back. Therefore even in the absence of any base current, the transistor will conduct current between collector and emitter if a sufficient driving voltage is applied between the collector and emitter to break down one of the abovementioned back-to-back diodes and allow the transistor to conduct. Clearly if such a break down occurs at the time when interruption to the primary winding current is desired, then the primary winding current will be initially interrupted, and the back emf induced in the primary winding then results in a sharp voltage increase. If this increased voltage is sufficient to cause the transistor to conduct again, then an effective interruption to the primary winding current will not have been achieved. The result of such an ineffectual interruption is a low induced voltage in the secondary winding because the current flowing in the primary winding will not have a high rate of change of flow.

In addition, since the voltage rating of the transistor will have been exceeded at each interruption to the primary winding current, the life of the transistor device will be extremely limited and the device will fail in a very short period of time. In order to overcome such failures in transistor ignition circuits which have previously been operated from conventional coil assemblies, it has been necessary to use a switching device which has a very high voltage rating. Accordingly such a device is extremely expensive when compared with lower rating devices which are very much cheaper to purchase than the difference in the voltage rating would suggest at first sight.

The switched voltage produced by each of the coil assemblies of Table I when operated at a rotor speed of 1,000 S.F.P.M. with the circuit illustrated in FIG. 3 is set forth as follows.

| Coil No. | 1 | 2 | 3 | 4 | 5 | 6 | 7 |
|---|---|---|---|---|---|---|---|
| Vs. | 125 | 200 | 220 | 180 | 180 | 170 | 300 |

It will be seen that the switched voltage induced in the primary winding of the coil assembly of the preferred embodiment is considerably below that of the other coil assemblies and therefore lower cost semi-conductors may be used in conjunction with the coil assemblies of the present invention.

It will also be seen that coil No. 6, although it has a low primary winding inductance, because of the configuration of the permeable core of the coil, produces a switched voltage Vs which is comparable with the other coils having higher primary winding inductance. Accordingly coil No. 6 is not suitable for use with transistor switching devices having low voltage ratings.

From the foregoing it is apparent that the coils of the present invention, when used in conjunction with electronic ignition systems both of known and novel circuit design, significantly reduces the starting speed able to be attained by the magneto ignition system. In addition, the coils of the present invention produce a low switched voltage Vs and therefore enable electronic ignition systems having low cost semi-conductor switching devices to be used without damage at any speed especially at high engine revolutions. The combination of these two features enables a lower cost ignition system to be provided which has significantly improved performance.

Since the coil assembly of the present invention produces such a low switched voltage Vs it is possible to use a monolithic integrated circuit as the ignition circuit which is operated by the coil assembly. This has two important consequences, firstly the cost of the ignition circuit is greatly reduced and secondly high gain transistors are able to be used, either as separate devices or within an integrated circuit.

The results of the first consequence include not only cheaper construction costs for the circuit but also a smaller and more reliable circuit. However, the result of the use of high gain transistors affects the performance of the combination of coil assembly and circuit directly.

As explained above starting at low speed is achieved when the current produced by the primary winding Ip exceeds a predetermined level, It, at which transistor T2 turns on. If transistor T2 is a high gain transistor this means that the magnitude of the predetermined level of It is effectively lowered. As a result starting is achieved at lower speeds since only a smaller primary winding current need be generated to cause ignition.

The coils of the present invention are characterized by a primary winding inductance of less than 3 mH and are mounted in an ignition coil assembly in which the magnetically permeable core of the assembly only partially encloses the coils thereby leaving at least one side of the coils free of the permeable core. Preferably the number of turns in the primary winding lies between 50 and 150 turns. The diameter of the primary winding wire may vary between 0.003 to 0.045 inches.

Furthermore the coils of the present invention when operated in conjunction with a megneto rotor are characterized by the production of high magnitude peak short-circuit saturation primary currents and by rapid rates of change for peak short-circuit primary currents for changes in magneto rotor speed at low rotor speeds. In addition, the coils of the present invention are further characterized by their ability to deliver high peak powers to resistive loads.

In particular it will be apparent from FIG. 43 of the drawings, that the coil assemblies of the present invention would be quite unsuitable for use with conventional mechanical breaker point ignition systems since the high primary currents produced on closure of the points of such a system would quickly burn the points during operation and result in very limited operating life for the points.

Another advantage of the coil assembly of the present invention is that the high primary currents produced provide power to operate the circuits of the type illustrated in FIGS. 24, 25, 26 and 28. In addition, the current characteristic shown in FIG. 43 is of assistance in operating automatic advance ignition circuits of the type illustrated in FIG. 13.

In order to construct the above-described coil of the preferred embodiment the following empirical procedure was adopted. A number of hand wound laboratory prototype coils were constructed so as to be suitable for a conventional magneto rotor and the laminated core illustrated in FIG. 32. A number of different wire thicknesses were selected for the primary winding ranging in thickness between 0.003 and 0.045 inches. The number of turns in the primary winding for each coil was varied between the limits of approximately 50 and 150 turns.

A substantially standard secondary winding was constructed having an internal diameter sufficient to accommodate the various different sizes of primary windings. The preferred form of secondary winding comprised 12,500 turns of wire having a thickness of 0.0024 inches. The above-described preferred embodiment of the ignition circuit of the present invention illustrated in FIG. 3 was then operated from a magneto coil assembly including, in turn, each combination of the various primary windings and the standard secondary winding. The rotor R.P.M. required to produce a specified secondary winding sparking voltage was then recorded for each wire gauge and each selected number of primary turns. The rotor, magnet poles, and laminations described in connection with coil No. 1 in Table I were used in each case. The specified sparking voltage selected as a laboratory reference was 10 kV for the above-described secondary winding, however, the magnitude of the secondary voltage was able to be increased or decreased by respectively increasing or decreasing the number of turns in the secondary winding.

It was found that for each gauge of primary wire thickness, a particular number of turns produced a minimum number of revolutions required to produce the specified secondary voltage. Increasing or decreasing the number of primary turns away from this specified number of turns in both cases increased the R.P.M. required to produce the specified secondary voltage. For example, for a primary winding wire of thickness 0.040 inches both 120 and 140 primary turns produced a secondary voltage of 10 kV at 400 R.P.M. However, the specified reference voltage of 10 kV was produced at 350 R.P.M. for 130 primary turns. Similarly for primary winding wire having a thickness of 0.025 inches, a primary winding having 130 turns required 450 R.P.M. to produce the desired 10 kV, a primary winding having 150 turns required 350 R.P.M. to produce the secondary reference voltage of 10 kV, but a primary winding having 140 turns only required 310 R.P.M. to produce the same secondary reference voltage of 10 kV.

Since 310 R.P.M. was the lowest speed achieved with the hand-wound laboratory prototype coils; 140 primary turns and a primary winding gauge of 0.025 inches together with a secondary winding gauge of 0.0024 inches and 12,500 secondary turns were selected as the winding combination to be used in the construction of a run of identical production coils.

For economic reasons relating to the cost of production and the cost of preparing the necessary machinery prior to manufacture, only the single abovementioned winding combination was selected for the manufacture of a number of production coils, each having the laminated core illustrated in FIG. 32. The performance of each of the production coils was identical and has been described above in relation to coil No. 1 of Table I. It will be seen that the performance of the coil manufactured by production techniques was increased above the performance produced by the best hand-wound prototype coil having the same winding combination.

Production coils produced in accordance with the present invention have proved capable of producing secondary voltages in excess of 32 kV at 220 R.P.M. and 40 kV at 500 R.P.M. These results were obtained with coils having 140 primary turns and in excess of 12,500 secondary turns.

The foregoing describes only some embodiments of the present invention and modifications, obvious to those skilled in the art, may be made thereto without departing from the scope of the present invention.

TABLE I

| Coil No. | Brand Part No. | Np | Dp | Lp | Rp | Ns | Ds | Rd | R.P.M./ S.F.P.M. | Ma | La |
|---|---|---|---|---|---|---|---|---|---|---|---|
| 1 | Solo | 140 | 0.025 | 2.0 | 0.67 | 12,500 | 0.0024 | 6.563 | 1.719 | 0.675 × 1.015<br>0.685<br>(2) | 0.445 × 0.500<br>0.223 |
| 2 | Victa<br>5-183 | 195 | 0.025 | 3.93 | 0.99 | 7,000 | 0.0024 | 6.563 | 1.719 | 0.675 × 1.015<br>0.685<br>(2) | 0.445 ×0.500<br>0.223 |
| 3 | Husqvarna<br>(Bosch)<br>523/60<br>2204/222/053 | 195 | 0.024 | 3.51 | 0.86 | 11,550 | 0.0012<br>to<br>0.0014 | 3.3125 | 0.868 | 0.490 × 0.755<br>0.370<br>(2) | 0.355 × 0.365<br>0.130 |
| 4 | McCulloch<br>(Phelon) | 200 | 0.020 | 3.02 | 0.97 | 10,050 | 0.0023 | 3.5 | 0.917 | 0.510 × 0.900<br>0.459<br>(2) | 0.365 × 0.375<br>0.137 |
| 5 | Wico | 190 | 0.021 | 3.13 | 0.83 | 10,350 | 0.0016 | 4.5 | 1.18 | 0.800 × 0.550<br>0.440<br>(2) | 0.365 × 0.380<br>0.139 |
| 6 | 75 | 0.027 | 2.0 | 0.49 | 4,400 | 0.0024 | 5.75 | 1.506 | 0.725 ×<br>2.000 | 0.445 × 0.500 | |
| Brig-gs & | Stratton | | | | | | | | | 1.450<br>(1) | 0.223 |
| 7 | Solo<br>(Bosch)<br>Type 411<br>2/204/210013 | 300 | 0.0145 | 9.53 | 2.33 | 11,800 | 0.0015 | 3.563 | 0.933 | 0.950 × 2.025<br>1.924<br>(2) | 0.160 × 0.400<br>0.064 |

We claim:

1. An ignition circuit for an internal combustion engine having a coil assembly including a primary winding with two ends and a magnet carrying rotor rotatable by said engine past said primary winding, said ignition circuit comprising:

first and second transistors, each having a collector, a base and an emitter, the collector of the first transistor being directly connected to one end of said primary winding and the emitter of the first transistor being directly connected to the other end of said primary winding, the second transistor having its collector-emitter conduction path connected in parallel with the base-emitter conduction path of said first transistor;

a first resistor connected between base and collector of the first transistor;

a potential divider directly connected across the ends of said primary winding, and the base of said second transistor being connected to a point of intermediate potential on said potential divider wherein rotation of said rotor induces a voltage between the ends of said primary winding to cause said first transistor to conduct current from said primary winding directly through the collector-emitter conduction path of said first transistor, said second transistor being turned on by said intermediate potential to turn said first transistor off when said current exceeds a predetermined value.

2. An ignition circuit for an internal combustion engine having a coil assembly including a primary winding with two ends and a magnet carrying rotor rotatable by said engine past said primary winding, said ignition circuit comprising:

first and second transistors, each having a collector, a base and an emitter, the collector of the first transistor being directly connected to one end of said primary winding and the emitter of the first transistor being directly connected to the other end of said primary winding, the second transistor having its collector-emitter conduction path connected in parallel with the base-emitter conduction path of said first transistor;

a first resistor connected between base and collector of the first transistor;

a potential divider directly connected across the ends of said primary winding, and the base of said second transistor being connected to a point of intermediate potential on said potential divider wherein rotation of said rotor induces a voltage between the ends of said primary winding to cause said first transistor to conduct current from said primary winding directly through the collector-emitter conduction path of said first transistor without said first transistor being saturated, said second transistor being turned on by said intermediate potential to turn said first transistor off when said current exceeds a predetermined value.

3. The circuit as claimed in claim 2 wherein a diode is connected between said potential divider and the base of said second transistor to effectively raise the magnitude of said intermediate potential, the polarity of said diode and the polarity of the base-emitter junction of said second transistor being the same.

4. The circuit as claimed in claim 3 wherein said potential divider comprises two series connected resistors and a series connected diode.

5. The circuit as claimed in claim 2 wherein said first transistor comprises a Darlington pair.

6. The circuit as claimed in claim 2 wherein a diode is connected between the ends of said primary winding, the polarity of said diode being opposed to the collector-emitter conduction path of said first transistor.

7. The circuit as claimed in claim 2 wherein a zener diode is connected between the ends of said primary winding, the direction of forward current conduction of said zener diode being opposed to that of the collector-emitter conduction path of said first transistor.

8. The circuit as claimed in claim 2 wherein a resistor and series connected zener diode are connected between base and emitter of said first transistor, the polarity of said zener diode being opposed to the polarity of the base-emitter conduction path of said first transistor.

9. The circuit as claimed in claim 2 wherein said potential divider comprises two series connected resistors, the base of said second transistor being connected to the junction between said series connected resistors.

10. The circuit as claimed in claim 9 wherein a series connected resistor and capacitor are connected between the base of said second transistor and the collector of said first transistor.

11. The circuit as claimed in claim 9 wherein a capacitor is connected between base and emitter of said second transistor.

12. The circuit as claimed in claim 2 wherein said potential divider includes at least one thermistor.

13. The circuit as claimed in claim 2 wherein the resistance value of said first resistor is dependent upon temperature.

14. The circuit as claimed in claim 2 wherein said primary winding includes a tapping intermediate said ends and the collector of said first transistor is directly connected to said tapping only at high engine revolutions by a switch operatively responsive to engine revolutions.

15. The circuit as claimed in claim 2 wherein one terminal of a capacitor is connected to the emitter of said first transistor, the other terminal of said capacitor is connected via two series connected diodes having like polarity to the base of said second transistor, the polarity of said two series connected diodes being the same as the polarity of the base-emitter junction of said second transistor, a resistor connected in parallel with said capacitor, and a series connected diode and zener diode having opposed polarity connected between the collector of said first transistor and said other terminal of said capacitor, the direction of forward conduction of said zener diode being the same as the direction of conduction of the collector-emitter conduction path of said first transistor.

16. The ignition circuit as claimed in claim 2 wherein the maximum short circuit current in said primary winding produced by high speed rotation of said rotor is in excess of 4 amps.

17. The ignition circuit as claimed in claim 16 wherein at rotor speeds less than 200 surface feet per minute the rotor speed rate of change of short circuit primary winding current is in excess of 30 mA per surface foot per minute.

18. The ignition circuit as claimed in claim 2 wherein said primary winding has an inductance of less than 3 mH, is mounted on a magnetically permeable core which passes through the centre of said primary winding and which only partially encloses said coil assembly so as to leave at least one side thereof which is not adjacent a portion of said core.

19. The ignition circuit as claimed in claim 16 wherein said primary winding has between 50 and 150 turns.

20. The ignition circuit as claimed in claim 18 wherein said primary winding has between 50 and 150 turns.

21. The ignition circuit as claimed in claim 2 wherein the magnitude of said induced primary winding voltage causes said first transistor to repeatedly conduct primary winding current without being saturated, and said intermediate potential turns said second transistor on each time said current exceeds said predetermined value thereby resulting in multiple ignition.

22. The circuit as claimed in claim 2 wherein the base of said second transistor is directly connected to the point of intermediate potential on the potential divider.

* * * * *